US006576324B2

(12) United States Patent
Yoshino et al.

(10) Patent No.: US 6,576,324 B2
(45) **Date of Patent: *Jun. 10, 2003**

(54) PRINTING MEDIUM

(75) Inventors: Hitoshi Yoshino, Zama (JP); Yoshikuni Ito, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 35 days.

(21) Appl. No.: 08/625,708

(22) Filed: Apr. 3, 1996

(65) Prior Publication Data

US 2002/0048654 A1 Apr. 25, 2002

(30) Foreign Application Priority Data

Apr. 5, 1995 (JP) ..... 7-080218
Jul. 13, 1995 (JP) ..... 7-177495
Mar. 29, 1996 (JP) ..... 8-076397

(51) Int. Cl.[7] ..... B41M 5/00
(52) U.S. Cl. ..... 428/195
(58) Field of Search ..... 428/195, 206, 428/304.4, 329, 331

(56) References Cited

U.S. PATENT DOCUMENTS 4,202,870 A 5/1980 Weber et al. ..... 423/630
4,242,271 A 12/1980 Weber et al. ..... 260/448
4,879,166 A * 11/1989 Misuda et al. ..... 428/212
5,104,730 A 4/1992 Misuda et al. ..... 428/304.4
5,182,175 A * 1/1993 Sakaki et al. ..... 428/537.5
5,463,178 A * 10/1995 Suzuki et al.
5,523,149 A * 6/1996 Kijimuta et al.
5,683,784 A * 11/1997 Nakao et al. ..... 428/195
5,707,716 A * 1/1998 Yoshino et al. ..... 428/328
5,804,320 A * 9/1998 Tomioka et al. ..... 428/195
5,846,647 A * 12/1998 Yoshino et al. ..... 428/328
5,962,124 A * 10/1999 Yoshino et al. ..... 428/328

FOREIGN PATENT DOCUMENTS

EP 0500021 A1 8/1992
JP 51-38298 3/1976
JP 52-53012 4/1977
JP 53-49113 5/1978
JP 54-42399 4/1979
JP 54-59936 5/1979
JP 55-5830 1/1980
JP 55-51583 4/1980
JP 55-144172 11/1980

(List continued on next page.)

OTHER PUBLICATIONS

Porous structure of aluminum hydroxide and its content of pseudoboehmite, Applied Catalysis, 74 pp. 29–36 (1991).
The Journal of the American Chemical Society, vol. LVII, pp. 699–700 Jan.–Jun. 1935.
The Journal of the American Chemical Society, vol. LX, pp. 309–319 Jan.–Jun. 1938.
The Journal of the American Chemical Society, vol. LXXIII, pp. 373–380 Jan.–Mar., 1951.

*Primary Examiner*—Pamela R. Schwartz
(74) *Attorney, Agent, or Firm*—Fitzpatrick, Cella, Harper & Scinto

(57) ABSTRACT

Disclosed herein is a printing medium provided on a base material with a porous ink-receiving layer which comprises, as principal components, an alumina hydrate having a boehmite structure and a binder, wherein when measuring with an ink containing 0.1% by weight of a surfactant, the time required to absorb 30 ng of an ink is 400 milliseconds or shorter, the dye-adsorbing capacity falls within a range of from 900 to 2,000 mg/m$^2$, and the index of dye-adsorbing rate falls within a range of from 0.0 to 5.0.

13 Claims, 2 Drawing Sheets

FOREIGN PATENT DOCUMENTS

| | | |
|---|---|---|
| JP | 55-146786 | 11/1980 |
| JP | 57-173194 | 10/1982 |
| JP | 58-110287 | 6/1983 |
| JP | 60-46290 | 3/1985 |
| JP | 60-137685 | 7/1985 |
| JP | 60-171190 | 9/1985 |
| JP | 60-224580 | 11/1985 |
| JP | 60-232990 | 11/1985 |
| JP | 60-245588 | 12/1985 |
| JP | 60-260376 | 12/1985 |
| JP | 61-132376 | 6/1986 |
| JP | 61-237682 | 10/1986 |
| JP | 62-204990 | 9/1987 |
| JP | 62-264988 | 11/1987 |
| JP | 63-151477 | 6/1988 |
| JP | 1-97678 | 4/1989 |
| JP | 1-133779 | 5/1989 |
| JP | 1-222985 | 9/1989 |
| JP | 2-117880 | 5/1990 |
| JP | 2-276670 | 11/1990 |
| JP | 3-43291 | 2/1991 |
| JP | 3-45378 | 2/1991 |
| JP | 3-130187 | 6/1991 |
| JP | 4-115983 | 4/1992 |
| JP | 4-122672 | 4/1992 |
| JP | 4-202011 | 7/1992 |
| JP | 4-267180 | 9/1992 |
| JP | 5-16517 | 1/1993 |
| JP | 5-24335 | 2/1993 |
| JP | 5-16015 | 3/1993 |
| JP | 6-24123 | 2/1994 |
| JP | 6-114669 | 4/1994 |
| JP | 6-114671 | 4/1994 |
| JP | 6-297831 | 10/1994 |

* cited by examiner

PRINTING MEDIUM

BACKGROUND OF THE INVENTION

1. Field of the Invention

The present invention relates to a printing medium suitable for use in printing with inks. In particular, the present invention relates to a printing medium for ink-jet, which can provide images high in optical density and bright in color tone, scarcely causes beading even when using inks comprising a surfactant to improve their penetrability into printing media, and has excellent ink-absorbing capacity, a production process thereof, and an image-forming process using this medium.

2. Related Background Art

In recent years, an ink-jet recording system, in which minute droplets of an ink are flown by any one of various working principles to apply them to a printing medium such as paper, thereby making a record of images, characters and/or the like, has been quickly spread as a recording apparatus for various images in various applications including information instruments because it has features that printing can be conducted at high speed and with a low noise, color images can be formed with ease, printing patterns are very flexible, and development and fixing process are unnecessary.

Further, it begins to be applied to a field of recording of full-color images because images formed by a multi-color ink-jet system are comparable in quality with multi-color prints by a plate making system and photoprints by a color photographic system, and such printed images can be obtained at lower cost than the usual multi-color prints and photoprints when the number of copies is small.

With the improvement in printability such as speeding up and high definition of printing, and full-coloring of images, printing apparatus and printing methods have been improved, and printing media have also been required to have higher properties. This requirement has offered problems to be solved.

In order to solve such problems, a wide variety of printing media has heretofore been proposed. For example, Japanese Patent Application Laid-Open No. 52-53012 discloses paper for ink-jet, in which a base paper web having a low sizing degree is impregnated with a surface coating. Japanese Patent Application Laid-Open No. 53-49113 discloses paper for ink-jet, in which a sheet containing urea-formalin resin powder therein is impregnated with a water-soluble polymer. Japanese Patent Application Laid-Open No. 55-5830 discloses paper for ink-jet recording, in which a coating layer having good ink absorbency is provided on a surface of a base material. Japanese Patent Application Laid-Open No. 55-51583 discloses that non-crystalline silica is used as a pigment in a coating layer. Japanese Patent Application Laid-Open No. 55-144172 discloses an image-receiving sheet having a coating layer containing a pigment which adsorbs a coloring component in a water-based ink. Japanese Patent Application Laid-Open No. 55-146786 discloses that a coating layer formed of a water-soluble polymer is used.

In U.S. Pat. Nos. 4,879,166 and 5,104,730, and Japanese Patent Application Laid-Open Nos. 1-97678, 2-276670, 5-24335 and 6-297831, there have been proposed recording sheets each having an ink-receiving layer in which an alumina hydrate of a pseudoboehmite structure is used.

However, the ideas described in the above documents only relate to the improvement of properties such as ink absorbency, resolution, optical density, coloring ability, color reproducibility and transparency, and these documents do not describe anything about problems of beading which tends to markedly occur at printed areas on printing media when using inks comprising a surfactant, and means for solving such problems.

The term "beading" as used herein refers to a phenomenon caused by the fact that droplets of inks applied to a printing medium aggregate into larger droplets in the course of absorption and/or the like. It is said that beading readily occurs in particular on media low in ink absorbency or slow in fixing speed of a dye in an ink. This beading phenomenon is visually recognized as color irregularity about the size of a bead.

In a printing medium provided with an ink-receiving layer, beading is observed on the surface of the ink-receiving layer or in the interior of the ink-receiving layer.

There are the following problems in the conventional measures for the beading.

1. Japanese Patent Application Laid-Open Nos. 55-29546 and 6-24123 each disclose recording inks, in which a surfactant is added into the inks in a proportion ranging from several percent to ten-odd percent so as to improve the penetrability of the ink. These inks have an advantage that they can be used in printing on plain paper having a comparably high sizing degree. However, when printing is conducted with these inks on a porous ink-receiving layer comprising, as an principal component, a alumina or silica material, there arises a problem that the absorption of the inks becomes poor, or beading occurs. In particular, in an ink in which the concentration of the surfactant is increased near to a critical micelle concentration so as to enhance its penetrability, the ink components applied tend to aggregate on the ink-receiving layer to cause beading.

2. Japanese Patent Application Laid-Open Nos. 58-110287, 60-137685, 60-245588 and 02-276670 each disclose a printing medium in which the porous structure, such as pore radius distribution and pore volume, of an ink-receiving layer are adjusted to increase its ink-absorbing rate and ink absorption quantity.

Japanese Patent Application Laid-Open Nos. 05-024335 and 06-297831 each disclose a printing medium having an ink-receiving layer composed of pseudoboehmite and a binder, in which the thickness of the ink-receiving layer, a ratio of the pigment to the binder and a coating weight of the receiving layer are adjusted to increase its ink-absorbing rate and ink absorption quantity.

These are based on an idea that the ink-absorbing rate is increased, thereby preventing beading. However, the occurrence of beading also depends upon the fixing quantity and speed of a dye in an ink, so that the occurrence of beading cannot be prevented only by the increase of the ink-absorbing rate. Further, these documents do not describe anything about the measures for beading occurring upon the use of inks containing a surfactant.

3. Japanese Patent Application Laid-Open Nos. 57-173194, 60-046290, 63-151477, 04-115983 and 04-122672 each disclose a printing medium using a resin material having high solvent absorbency, while Japanese Patent Application Laid-Open Nos. 60-171190, 61-132376 and 03-043291 each disclose a printing medium to which a surfactant and the like are added.

These are based on an idea that a material high in ink absorbency or ink-diffusing ability is used to improve the absorption of ink. However, the beading phenomenon is also caused by aggregation of a dye in an ink, so that the occurrence of beading cannot be prevented only by the improvement of the ink absorbency. Further, these documents do not describe anything about the measures for beading occurring upon the use of inks containing a surfactant.

4. Japanese Patent Application Laid-Open No. 55-144172 discloses a printing medium provided with a receiving layer containing a pigment which adsorbs a dye in an ink, Japanese Patent Application Laid-Open No. 60-232990 a printing medium provided with an ink-receiving layer containing cationic aluminum oxide, Japanese Patent Application Laid-Open No. 62-264988 a printing medium containing a material which precipitates a dye in an ink, and Japanese Patent Application Laid-Open No. 01-097678 a printing medium using a substance having an adsorbing capacity of from 20 to 100 mg/g in combination with an ink absorbent.

These are based on an idea that the material high in adsorbing capacity is used to increase the adsorption quantity and adsorption rate of a dye in an ink. The water fastness of images printed is improved. However, since the quantity of the dye to be adsorbed on the ink-receiving layer also depends upon the specific surface area and coating weight of a material from which the receiving layer is formed, and low ink absorption also forms the main cause of beading, the occurrence of beading cannot be prevented only by the use of a material the dye-adsorbing capacity of which has been regulated. Further, these documents do not describe anything about the measures for beading occurring upon the use of inks containing a surfactant.

5. Japanese Patent Application Laid-Open No. 55-005830 discloses a printing medium in which the absorbency of an ink-receiving layer is within a range of from 1.5 to 1.8 mm/min, Japanese Patent Application Laid-Open No. 60-224580 a printing medium provided with an ink-receiving layer containing synthetic silica the surface of which has been treated with a silane coupling agent, Japanese Patent Application Laid-Open Nos. 60-260376 and 63-252779 each a printing medium to which a fluorine-containing surfactant or water-proofing and oil-proofing agent is added, and Japanese Patent Application Laid-Open Nos. 61-237682, 62-204990, 01-133779, 01-222985 and 02-117880 each a printing medium in which a hydrophobic substance is added in the interior of an ink-receiving layer composed of a hydrophilic resin, or on the surface thereof, or a hydrophobic part is provided on the surface of an ink-receiving layer. Besides, Japanese Patent Application Laid-Open Nos. 03-045378 and 03-130187 each disclose a printing medium provided with an ink-receiving layer the contact angle with an ink or the like of which is adjusted. These are based on an idea that the wettability of the surface of the ink-receiving layer is adjusted, whereby a dot diameter of an ink droplet applied is reduced to prevent ink droplets adjacent to each other from aggregating before the ink is absorbed.

However, the method of adjusting the wettability of the surface involves a problem that since its ink-absorbing rate becomes low, the resulting printing medium tends to cause beading when the quantity of an ink ejected on the printing medium increases. Further, these documents do not describe anything about the measures for beading occurring upon the use of inks containing a surfactant.

SUMMARY OF THE INVENTION

It is an object of the present invention to provide a printing medium which can suppress the occurrence of beading and feathering or bleeding even when using inks comprising a surfactant, has good ink absorbency, permits a choice of inks in a wide range, can provide images high in optical density, has good transparency when a transparent base material is used in that no difference arises in optical density and coloring of the resulting image between the observation from the side of an ink-receiving layer and the observation from the side of a base material or between the observation by reflection and the observation by transmission, and scarcely causes cracking or curling, an image-forming process using this printing medium, and a production process of the printing medium.

The above object can be achieved by the present invention described below.

According to the present invention, there is thus provided a printing medium provided on a base material with a porous ink-receiving layer which comprises, as principal components, an alumina hydrate having a boehmite structure and a binder, wherein when measuring with an ink containing 0.1% by weight of a surfactant, the time required to absorb 30 ng of the ink is 400 milliseconds or shorter, the dye-adsorbing capacity falls within a range of from 900 to 2,000 mg/m$^2$, and the index of dye-adsorbing rate falls within a range of from 0.0 to 5.0.

According to the present invention, there is also provided an image-forming process comprising the step of ejecting droplets of inks from ejection orifices of a printing head in response to printing signals to apply the ink droplets to the printing medium described above.

According to the present invention, there is further provided a process for producing the printing medium described above, comprising the steps of applying a dispersion comprising an alumina hydrate having a boehmite structure and a binder to a base material and drying it, thereby forming an ink-receiving layer, and heating the ink-receiving layer.

According to the present invention, there is still further provided a process for producing the printing medium described above, comprising the steps of preparing a mixed dispersion by adding at least one selected from the group consisting of metal alkoxides and materials capable of crosslinking a hydroxyl group to a dispersion comprising an alumina hydrate having a boehmite structure and a binder, applying the mixed dispersion to a base material and drying it, thereby forming an ink-receiving layer, and heating the ink-receiving layer.

According to the present invention, there is yet still further provided a process for producing the printing medium described above, comprising the steps of applying a dispersion comprising an alumina hydrate having a boehmite structure and a binder to a base material and drying it, thereby forming an ink-receiving layer, applying a liquid containing at least one selected from the group consisting of metal alkoxides and materials capable of crosslinking a hydroxyl group to the ink-receiving layer, and heating the ink-receiving layer.

DESCRIPTION OF THE PREFERRED EMBODIMENTS

Figure 1:
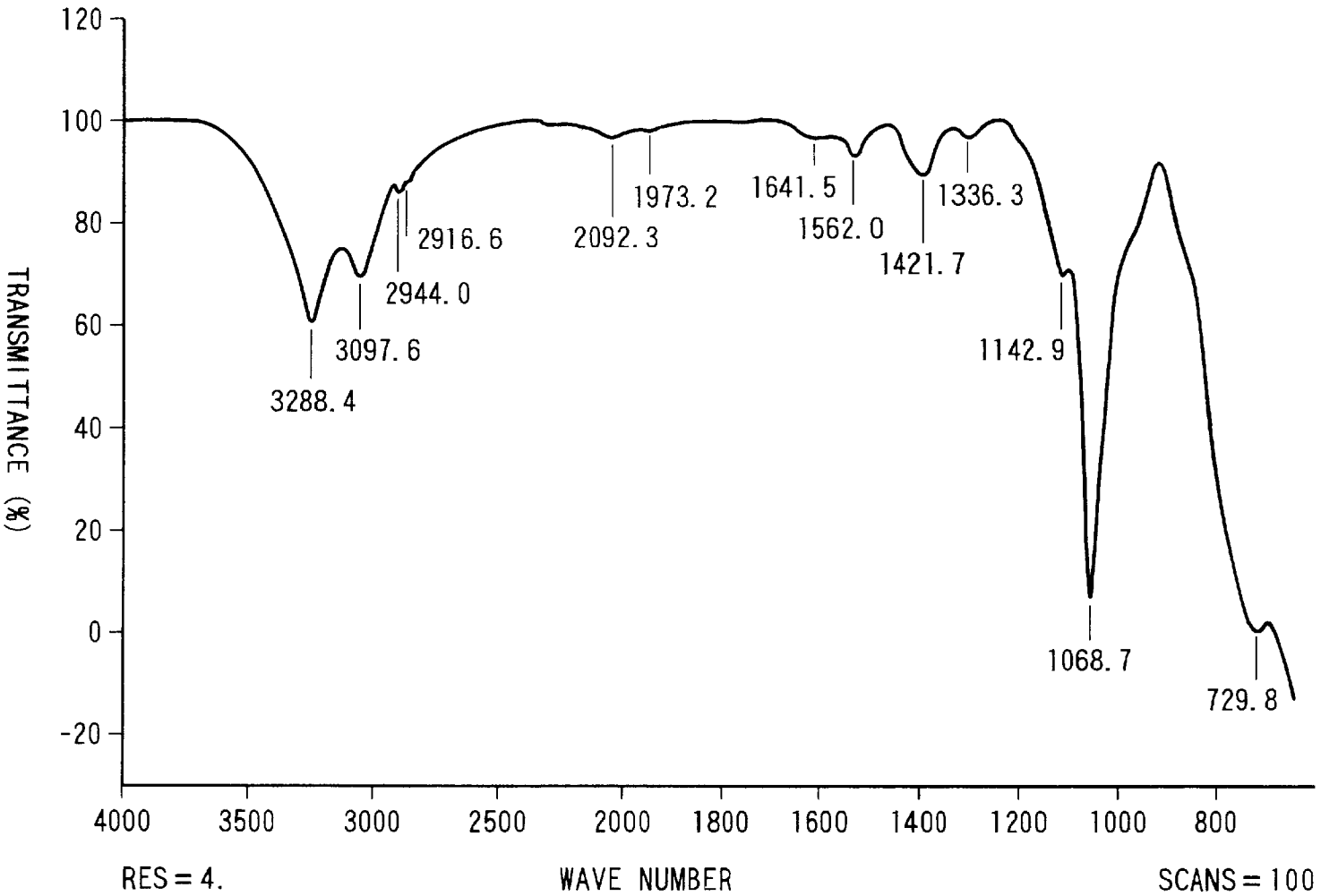
FIG. 1 illustrates an infrared transmittance of an ink-receiving layer according to Example 1 of the present invention before a heat treatment.

Each of the printing media according to the present invention is constructed by forming a porous ink-receiving layer composed principally of an alumina hydrate having a boehmite structure and a binder on a base material. A protective layer for prevention of marring, or the like, and/or a layer containing particles or the like, which serves to improve the conveying ability in an image-forming apparatus, may be formed on the ink-receiving layer as needed.

The porous ink-receiving layer as used herein refers to an ink-receiving layer the pore volume of which is detected when measured by the nitrogen adsorption and desorption method or by mercury intrusion porosimetry.

Alumina hydrates are preferable as materials used in the ink-receiving layer because they have a positive charge, so that a dye in an ink is well fixed and an image good in coloring is hence provided, and moreover there are no problems of bronzing of a black ink and fading upon exposure to light. Among the alumina hydrates, an alumina hydrate having a boehmite structure is most preferable because it has good dye-adsorbing ability, ink absorbency and transparency.

The alumina hydrate present in the printing media according to the present invention may preferably be an alumina hydrate showing a boehmite structure when analyzed by X-ray diffractometry.

The alumina hydrate is defined by the following general formula $$Al_2O_{3-n}(OH)_{2n}.mH_2O$$

wherein n is an integer of 0, 1, 2 or 3, m is a number of 0 to 10, preferably 0 to 5. In many cases, $mH_2O$ represents an aqueous phase which does not participate in the formation of a crystal lattice, but is able to eliminate. Therefore, m may take a value other than an integer.

A crystal of the alumina hydrate showing a boehmite structure is generally a layer compound the (020) plane of which forms a macro-plane, and shows a characteristic diffraction peak. Besides perfect boehmite, a structure called pseudoboehmite and containing excess water between layers of the (020) plane may be taken. The X-ray diffraction pattern of this pseudoboehmite shows a diffraction peak broader than that of the boehmite.

Since boehmite and pseudoboehmite may not be clearly distinguished from each other, alumina hydrates including both are called the alumina hydrate showing a boehmite structure (hereinafter referred to as the alumina hydrate) in the present invention unless expressly noted. The interplanar spacing of the (020) plane and the crystalline size in a direction perpendicular to the (020) plane can be determined by measuring a peak which appears at a diffraction angle 2θ of 14° to 15° and finding the interplanar spacing from the angle 2θ at which the peak appears, and a Full width at Half Maximum B in accordance with Bragg's formula, and the crystalline size in accordance with Scherrer's formula.

The interplanar spacing of the (020) plane may be used as an index to the hydrophilicity•hydrophobicity of the alumina hydrate.

No particular limitation is imposed on the production process of the alumina hydrates used in the present invention so far as an alumina hydrate having a boehmite structure can be produced. For example, the alumina hydrate can be produced by any conventional method such as the hydrolysis of an aluminum alkoxide or sodium aluminate. As disclosed in Japanese Patent Application Laid-Open No. 56-120508, an alumina hydrate having an amorphous form from the viewpoint of X-ray diffractometry may be heat-treated at 50° C. or higher in the presence of water to convert it to a boehmite structure before its use.

A process, which can be particularly preferably used in the present invention, is a process in which an acid is added to an aluminum long-chain alkoxide to hydrolyze and deflocculate the alkoxide, thereby obtaining an alumina hydrate. The term "aluminum long-chain alkoxide" as used herein means an alkoxide having, for example, 5 or more carbon atoms. Further, the use of an alkoxide having 12 to 22 carbon atoms is preferred because the removal of alcohol formed and the shape control of the alumina hydrate can be conducted with ease as described below.

As the acid to be added, one or more acids may be freely selected from organic and inorganic acids. However, nitric acid is most preferable from the viewpoint of the reaction efficiency of the hydrolysis, and the shape control and dispersion property of the resulting alumina hydrate. It is also possible to conduct a hydrothermal synthesis or the like after this process so as to control the particle size of the alumina hydrate. When the hydrothermal synthesis is conducted using an alumina hydrate dispersion containing nitric acid, the nitric acid in the aqueous solution can be introduced in the form of a nitrate group into the surface of the alumina hydrate, thereby improving the dispersion property in water of the alumina hydrate.

The process by the hydrolysis of the aluminum alkoxide has an advantage that impurities such as various ions are hard to get mixed as compared with the process for producing alumina hydrogel or cationic alumina. The use of the aluminum long-chain alkoxide also has an advantage that since the long-chain alcohol formed is easy to remove after the hydrolysis, the removal of the alcohol from the alumina hydrate can be completely conducted as compared with the case where a short-chain alkoxide such as aluminum isopropoxide is used. In this process, it is preferable to preset the pH of a solution to 6 or lower upon the initiation of the hydrolysis. Any pH higher than 8 is not preferable because the alumina hydrate to be finally obtained will become crystalline.

In the printing media according to the present invention, the alumina hydrate and a binder are principally used to form an ink-receiving layer. The values of physical properties of the printing media may be changed by various production conditions such as the kinds and mixing ratio of the alumina hydrate and binder to be used, the kinds and amounts of additives to be used, the dispersion conditions of a coating formulation in which the alumina hydrate is dispersed, and the heating conditions upon drying of the coating formulation.

The printing media according to the present invention preferably have such properties that when measuring with an ink containing 0.1% by weight of a surfactant, the time required to absorb 30 ng of the ink dropped on the ink-receiving layer is 400 milliseconds or shorter, the dye-adsorbing capacity falls within a range of from 900 to 2,000 $mg/m^2$, and the index of dye-adsorbing rate falls within a range of from 0.0 to 5.0.

So far as the printing medium has property values within the above ranges, the aggregation of ink droplets at the surface of the ink-receiving layer can be prevented, and a dye in the ink absorbed can be quickly fixed to the porous-structure surface in the ink-receiving layer without aggregation. Therefore, the occurrence of beading, feathering or bleeding and cissing can be prevented, and an image can be formed with high optical density. Besides, a printing medium in which the ink-receiving layer is provided on a transparent base material has such effects that no beading is recognized even when the resultant image is observed from the side of the base material, and so little difference arises in optical density and coloring of the image between the observation from the side of the ink-receiving layer and the observation from the side of the base material or between the observation by transmission and the observation by reflection.

More specifically, it is preferable that the ink-absorbing time be 400 milliseconds or shorter when conducting printing of 16×16 dots per $mm^2$ (100% printing) on the ink-receiving layer with an ink containing 0.1% by weight of a surfactant, the amount of each of said ink dots being 30 ng, and that the ink-absorbing time be 600 milliseconds or shorter when conducting printing of 16×16 dots per $mm^2$ twice (200% printing) at an interval of 130 milliseconds, since none of ink feathering, beading and bleeding occur even when solid printing or multi-color printing is conducted on such a printing medium.

The dye adsorbing capacity is preferably 150% or higher of the maximum quantity of a dye in an ink to be ejected because the dye can be fixed without aggregation even when printing is conducted with inks containing a surfactant.

The cissing as used herein refers to unevenness of color strength caused by the formation of portions not colored with a dye in a solid printed area.

If the ink-absorbing time exceeds 400 milliseconds, the ink droplets become greater beads on the surface of the ink-receiving layer before they are absorbed, whereby the dye aggregates, resulting in the occurrence of beading, feathering and/or bleeding. The feathering as used herein refers to a phenomenon that when solid printing is conducted at a fixed area, a portion colored with a dye becomes wider (greater) than a printed area. The bleeding refers to a phenomenon that when multi-color solid printing is conducted, feathering occurs at boundaries between different colors, and so the respective dyes are not fixed, but mix with each other.

The dye-adsorbing capacity as used herein refers to a maximum adsorption quantity within limits for a dye not to run out when printing is conducted on a printing medium with a water-based ink comprising 3% by weight of C.I. Food Black 2 and 0.1% by weight of a surfactant with the shot-in ink quantity varied and the printing medium thus printed is left to stand at room temperature until the ink is completely dried, and then immersed in deionized water. Here, it should be borne in mind that the dye-adsorbing capacity and adsorption rate depend on the concentration of a dye in an ink.

Japanese Patent Application Laid-Open No. 1-97678 discloses a method in which alumina sol is added into water, and an ink containing a dye is dropped therein, thereby conducting measurement. However, since the concentration of the dye is thin, the adsorption rate is extremely low compared with the dropping rate. Therefore, the adsorption quantity cannot be exactly determined, and besides the alumina sol colored with the dye cannot be separated from a supernatant because the alumina sol has good dispersion property in water, so that the coloring state of the supernatant cannot be observed. Accordingly, such a method is not a suitable measuring method.

If the dye-adsorbing capacity is lower than 900 $mg/m^2$, the dye in the ink applied is not fully adsorbed, so that feathering may occur, the dye aggregates in the interior of the ink-receiving layer, thereby lowering the optical density of an image formed when observing by transmission or from the side of the base material, or the water fastness of the image may be deteriorated in some cases. If the dye-adsorbing capacity exceeds 2,000 mg/m2, the dye is fixed before the ink is fully spread, so that the diameter of printed dots becomes too small, and blank areas are hence caused, resulting in an unnatural image like a stipple.

The index of dye-adsorbing rate as used herein refers to a slope determined in the following manner. An ink (hereinafter referred to as the clear ink) having an ink composition except for omission of a dye and containing 1.0% by weight of a surfactant is used to conduct printing on a printing medium from 100% to a maximum quantity within limits not causing ink feathering on the surface of an ink-receiving layer. Printing is then conducted on the printed surface of the above printing medium at a low density with an ink (hereinafter referred to as the dye-containing ink) comprising 3.0% by weight of a dye and 0.1% by weight of the surfactant, thereby measuring a diameter of a printed dot. Similarly, printing is conducted on a printing medium not printed with the clear ink at a low density with the same dye-containing ink, thereby measuring a diameter of a printed dot. A ratio of the dot diameter of the printing medium printed with the clear ink to the dot diameter of the printing medium not printed with the clear ink is found, and the value thus obtained is multiplied by 100. The quantity of the clear ink applied within limits not causing ink feathering and the value obtained by multiplying the ratio between the dot diameters by 100 are plotted. This relationship is regarded as a linear function to determine the slope. This index is a physical quantity indicative of spreading of the dot diameter due to the feathering caused by the influence of the clear ink.

A printing medium the index of dye-adsorbing rate of which is 0.0 means that the diameters of individual dots at the time printing is conducted with the dye-containing ink on the printing medium, to which no clear ink has been applied or to which the clear ink has been applied separately from 100% to 400%, are the same. A printing medium the index of dye-adsorbing rate of which is 5.0 means that diameters of dots at the time printing is conducted with the dye-containing ink on the printing medium, to which no clear ink has been applied separately from 100%, 200%, 300% and 400%, are 1.05, 1.10, 1.15 and 1.20 times, respectively, of that of the printing medium to which no clear ink has been applied.

If the index of dye-adsorbing rate is smaller than 0.0, the dye in the ink applied aggregates on the ink-receiving layer or in the interior thereof, so that the correspondence of the quantity of the ink applied to the optical density becomes poor, and gradation is hence deteriorated. In particular, beading is observed when the resultant image is observed by transmission or from the side of the base material. If the index exceeds 5.0 on the other hand, the ink applied is spread in the state that the dye in the ink is not fixed, so that feathering occurs, and a mixed-color area obtained by multi-color printing does not become a tint corresponding to the quantitative proportion of the mixed inks.

In the printing medium according to the present invention, the ink-receiving layer preferably has a surfactant-adsorbing capacity ranging from 300 to 1,000 $mg/m^2$. So far as the printing medium has the capacity within this range, the occurrence of beading can be prevented even when an ink, to which about 1 to 10% by weight of a surfactant is added to enhance its penetrability with a view toward conducting printing on paper having a high sizing degree, or the like, is used, and so the choice of inks can be permitted in a wide range.

In the present invention, the surfactant-adsorbing capacity may be determined in the following manner. The above-described clear ink containing 1.0% by weight of a surfactant (Surfynol 465, trade name, product of Nisshin Chemical Industry Co., Ltd.) is used to conduct printing on the printing medium with the quantity of the clear ink varied, thereby determining a maximum quantity of the clear ink within limits for the printed area not to become opaque white. This maximum quantity is converted to the surfactant-adsorbing capacity. Even in this case, the concentration of the surfactant is important.

If the concentration of the surfactant is lower than 1% by weight, the surfactant-adsorbing rate becomes low, and the quantity of the clear ink to be applied increases to cause ink feathering. Therefore, the adsorption quantity cannot be measured with precision. If the concentration of the surfactant is higher than 1% by weight, the surfactant itself becomes easy to aggregate, so that the measurement cannot be conducted with precision. If the surfactant-adsorbing capacity is lower than the lower limit of the above range, a printing medium having such an ink-receiving layer tends to cause beading when printing is conducted with an ink containing the surfactant in a greater amount. If the capacity exceeds the upper limit of the above range on the other hand, the adsorption and fixing of dyes to such an ink-receiving layer may be inhibited, and so the water fastness of the resulting image may be deteriorated in some cases.

The reason for it is considered to be as follows. Namely, since the surfactant has a negative charge opposite to the alumina hydrate, the surfactant in the ink applied is adsorbed on the surface of the alumina hydrate having a positive charge in the ink-receiving layer. In the course of the adsorption, the solvent component in the ink diffuses into the ink-receiving layer. Therefore, the concentration of the surfactant is increased near to a critical micelle concentration (CMC) to generate aggregate. When the aggregate is generated, its surface potential (zeta potential) becomes higher, and so the growth of the aggregate is further facilitated. The dye is added into such aggregate, thereby causing beading. Alternatively, the dye and surfactant are present in the ink with both components forming a micelle structure. When the ink ejected reaches the ink-receiving layer, the surfactant is easily to be adsorbed because of its high surface potential, and is first adsorbed on the surface of the alumina hydrate. As a result, the micelle structure is broken, and the dye remaining in the solvent aggregates by itself to cause beading.

Preferably, the printing medium satisfying the above surfactant-adsorbing capacity further has such properties that when measuring with an ink containing 1.0% by weight of a surfactant, the time required to absorb 30 ng of the ink is 400 milliseconds or shorter, and a dye-adsorbing capacity ratio falls within a range of from 0.6 to 1.2. So far as the printing medium has such properties within the above ranges, the occurrence of feathering and cissing can be prevented even when printing is conducted on the printing medium with inks containing 1 to 10% by weight of a surfactant. The dye-adsorbing capacity ratio as used herein means a ratio (B/A) of the capacity (B) of adsorbing a dye in an ink containing 1.0% by weight of a surfactant to the capacity (A) of adsorbing a dye in an ink containing 0.1% by weight of the surfactant. If the ratio exceeds the upper limit of the above range, an image formed on such a printing medium with, in particular, an ink containing a surfactant in a great amount tends to migrate. If the ratio is lower than the lower limit of the above range, the optical density and tint of an image printed on such a printing medium become easy to change according to the amount of the surfactant added into the ink used.

The interplanar spacing of the (020) plane of the alumina hydrate in the printing medium according to the present invention is preferably within a range of from 0.617 nm to 0.620 nm. When the interplanar spacing is within this range, cissing and feathering scarcely occur even when printing is conducted on such a printing medium with an ink containing a surfactant. In addition, dyes can be chosen in a wide range, and high optical density can be achieved even when either a hydrophobic dye or a hydrophilic dye is used, or both dyes are used in combination. Further, the dot diameter of each dye can be made even. It is also possible to prevent the occurrence of curling or cracking.

According to a finding of the present inventors, the interplanar spacing-of the (020) plane correlates to the crystalline size in a direction perpendicular to the (020) plane, so that the crystalline size in a direction perpendicular to the (020) plane can be controlled within a range of from 6.0 to 10.0 nm if the interplanar spacing of the (020) plane is within the above range.

The reason for it is considered to be as follows. Namely, if the interplanar spacing of the (020) plane is within the above range, the proportion between the hydrophilicity and the hydrophobicity of the alumina hydrate in the printing medium falls within an optimum range. Therefore, such alumina hydrate has good adsorptivity to various dyes and solvents, and moreover high bonding strength to a binder resin, and so no cracking occurs. Besides, the amount of water contained between layers of the alumina hydrate is not too much. Therefore, such a printing medium permits the choice of inks in a wide range, scarcely causes cissing and feathering, and also cracking and curling.

If the interplanar spacing is shorter than the lower limit of the above range, the catalytic active sites of such an alumina hydrate increases, so that an image printed on the printing medium becomes easy to cause discoloration with time. Further, the hydrophobicity on the surface of the alumina hydrate becomes strong, so that wettability by inks becomes insufficient. Therefore, the resulting printing medium tends to cause cissing, or on the other hand, to cause feathering and beading when a hydrophilic dye is used. In addition, the bonding strength to the binder resin becomes weak, so that the resulting printing medium tends to cause cracking and dusting.

If the interplanar spacing exceeds the upper limit of the above range, the amount of water contained between layers of such an alumina hydrate increases, and the amount of water evaporated upon the application of a coating formulation containing the alumina hydrate hence increases, so that the resulting printing medium tends to cause curling and/or cracking. In addition, such an alumina hydrate has high water absorption, so that the resulting printing medium may cause curling and cracking, or undergo a change of ink absorption according to environmental conditions. Further, since the surface of the alumina hydrate becomes hydrophilic, the printing medium tends to cause feathering and beading when a hydrophobic dye is used, and the water fastness of an image printed on the medium is deteriorated.

The crystalline size in a direction perpendicular to the (020) plane of the alumina hydrate in the printing medium according to the present invention is preferably within a range of from 6.0 to 10.0 nm because the printing medium is provided with good transparency, ink absorbency and dye adsorptivity and scarcely causes cracking. If the size is smaller than the lower limit of the above range, the dye adsorptivity of the resulting printing medium is lowered, so that the optical density of an image printed on the medium is lowered. Besides, the bonding strength of such an alumina hydrate to the binder becomes low, resulting in a printing medium that is readily subject to cracking. If the size exceeds the upper limit of the above range, haze occurs on the printing medium, and so its transparency is deteriorated, and the optical density of an image printed on the medium is further lowered.

As the alumina hydrate used in the present invention, alumina hydrates containing a metal oxide such as titanium dioxide or silica may be employed so far as they show a boehmite structure when analyzed by X-ray diffractometry. Among the metal oxides, titanium dioxide is most preferable from the viewpoint of increasing the dye adsorption of the resulting ink-receiving layer and not impairing the dispersibility of the alumina hydrate.

The content of titanium dioxide is preferably within a range of from 0.01 to 1.00% by weight based on the alumina hydrate. The inclusion of titanium dioxide within this range makes it possible to enhance the optical density of an image printed on the resulting printing medium and improve the water fastness of the image. It is more preferable to contain titanium dioxide in a proportion ranging from 0.13 to 1.00% by weight because the dye-adsorbing rate of the resulting printing medium becomes high, so that feathering or bleeding and beading are unlikely to occur.

The content of titanium dioxide in the alumina hydrate can be determined by fusing an alumina hydrate sample in boric acid in accordance with the ICP method. The distribution of titanium dioxide in the alumina hydrate and the valence of titanium in the titanium dioxide can be analyzed by means of an ESCA.

The surface of an alumina hydrate sample is etched with an argon ion for 100 seconds and 500 seconds to determine the distribution change in content of titanium dioxide.

Further, the valence of titanium in titanium dioxide must be +4 for the purpose of preventing the discoloration of an image printed on the resulting printing medium. If the valence of titanium in titanium dioxide becomes lower than +4, the titanium dioxide comes to serve as a catalyst, and the binder is hence deteriorated, so that the resulting printing medium is readily subject to cracking and dusting, and an image printed on the medium is discolored.

The alumina hydrate may contain titanium dioxide either only in the vicinity of the surface of the alumina hydrate or up to the interior thereof. Its content may be changed from the surface to the interior. Titanium dioxide may preferably be contained only in the close vicinity of the surface of the alumina hydrate because the bulk crystal structure and physical properties of the alumina hydrate are easy to maintain. As the alumina hydrate containing titanium dioxide, there may be used an alumina hydrate described in, for example, Japanese Patent Application No. 6-114670.

Although oxides of magnesium, calcium, strontium, barium, zinc, boron, silicon, germanium, tin, lead, zirconium, indium, phosphorus, vanadium, niobium, tantalum, chromium, molybdenum, tungsten, manganese, iron, cobalt, nickel, ruthenium and the like may be used instead of titanium dioxide, titanium dioxide is most preferred from the viewpoint of adsorptivity of a dye in an ink and dispersibility. Most of the oxides of the above-mentioned metals are colored, while titanium dioxide is colorless. Even from this viewpoint, the titanium dioxide is preferred.

As a process for producing the titanium dioxide-containing alumina hydrate, a process as described in Gakkai Shuppan Center, "Science of Surfaces", edited by Kenji Tamaru, 327 (1985), in which a liquid mixture of an aluminum alkoxide and a titanium alkoxide is hydrolyzed, is most preferred. As another process, its production may also be conducted by adding an alumina hydrate as a nucleus for crystal growth upon the hydrolysis of the mixture of the aluminum alkoxide and the titanium alkoxide.

The shape (particle diameter, particle shape, aspect ratio) of the alumina hydrate can be determined in the following manner. An alumina hydrate sample is dispersed in water, alcohol or the like, and the resultant dispersion is dropped on a collodion membrane to prepare a sample for measurement. This sample is observed through a transmission electron microscope. As described in literature [Rocek J., et al., Applied Catalysis, Vol. 74, 29–36 (1991)], it is generally known that pseudoboehmite among alumina hydrates has both needle form (the ciliary form) and another form. In the present invention, an alumina hydrate in the form of either a needle or a flat plate may be used.

According to a finding of the present inventors, the alumina hydrate in the flat plate form has better dispersibility in water than that of the needle form (the ciliary form or bundle form), and the orientation of particles of the alumina hydrate becomes random when forming an ink-receiving layer, so that the range of the pore radius distribution widens. Such an alumina hydrate is hence more preferred. The bundle form as used herein refers to a state that alumina hydrates in the form of a needle aggregate like a hair bundle with their sides in contact.

The aspect ratio of particles in the form of a flat plate can be determined in accordance with the method defined in Japanese Patent Publication No. 5-16015. The aspect ratio is expressed by a ratio of "diameter" to "thickness" of a particle. The term "diameter" as used herein means a diameter of a circle having an area equal to a projected area of the particle, which has been obtained by observing the alumina hydrate through a microscope or an electron microscope.

The slenderness ratio means a ratio of a minimum diameter to a maximum diameter of the flat plate surface when observed in the same manner as in the aspect ratio. In the case of the bundle form, the aspect ratio can be determined by regarding the individual needle particles, from which a bundle is formed, as a cylinder, and finding diameters of upper and lower circles and a length of the cylinder to use as a ratio of the length to the diameter.

The most preferable shape of the alumina hydrate is such that in the form of a flat plate, the average aspect ratio is within a range of from 3 to 10, and the average particle diameter is within a range of from 1 to 50 nm. In the case of the bundle form, on the other hand, it is preferred that the average aspect ratio be within a range of from 3 to 10, and the average particle length be within a range of from 1 to 50 nm. When the average aspect ratio falls within the above range, a porous structure that the range of the pore radius distribution is wide can be formed with ease because spaces are defined between particles of the alumina hydrate when the ink-receiving layer is formed, or the alumina hydrate is contained in a fibrous material. When the average particle diameter or average particle length falls within the above range, a porous structure that the pore volume is great can be similarly formed.

If the average aspect ratio of the alumina hydrate is lower than the lower limit of the above range, the range of the pore radius distribution of the resulting ink-receiving layer narrows. On the other hand, any average aspect ratio higher than the upper limit of the above range makes it difficult to produce the alumina hydrate with its particle size even. If the average particle diameter or average particle length is smaller than the lower limit of the above range, the range of the pore radius distribution similarly narrows. If the average particle diameter or average particle length is greater than the upper limit of the above range, the resulting printing medium cannot sufficiently adsorb a dye in an ink applied thereto.

The alumina hydrate is used to prepare a coating dispersion, the dispersion is applied to a base material and dried, whereby an ink-receiving layer can be formed on the base material.

The BET specific surface area, pore radius distribution, pore volume and isothermal nitrogen adsorption and desorption curve of the ink-receiving layer according to the present invention can be obtained at the same time by the nitrogen adsorption and desorption method. The BET specific surface area is preferably within a range of from 70 to 300 $m^2/g$. When the BET specific surface area falls within this range, the resulting ink-receiving layer has good transparency and a fully great area to adsorb dyes, so that the dye adsorption is improved. If the BET specific surface area is smaller than the lower limit of the above range, the resulting ink-receiving layer becomes opaque white, or its adsorption sites to a dye in an ink become insufficient, so that the water fastness of an image printed thereon is lowered. If the BET specific surface area is greater than the upper limit of the above range, the resulting ink-receiving layer becomes easy to cause cracking.

In the present invention, the following first and second pore structures may be used. As needed, either of them may be selected, or they may be used in combination.

In the first pore structure according to the present invention, the average pore radius of the ink-receiving layer is preferably within a range of from 2.0 to 20.0 nm, while its half breadth of pore radius distribution is preferably within a range of from 2.0 to 15.0 nm. The average pore radius is determined from the pore volume and BET specific surface area as described in Japanese Patent Application Laid-Open Nos. 51-38298 and 4-202011.

The term "half breadth of pore radius distribution" as used herein means a breadth of pore radius which is a magnitude half of the magnitude of the average pore radius. As described in Japanese Patent Application Laid-Open Nos. 4-267180 and 5-16517, a dye in an ink is selectively adsorbed in pores of a specific radius. However, when the ink-receiving layer has the average pore radius and the half breadth within the above ranges, respectively, the range of choice of dyes can be widened, so that even when either of hydrophobic and hydrophilic dyes is used, the occurrence of feathering, bleeding, beading and cissing is prevented, and the optical density and dot diameter upon printing can hence be made even. If the average pore radius is larger than the upper limit of the above range, the resulting printing medium is deteriorated in the adsorption and fixing of a dye in an ink, and so feathering or bleeding tends to occur on an image formed. If the average pore radius is smaller than the lower limit of the above range, the resulting printing medium is deteriorated in ink absorbency, and so beading tends to occur. If the half breadth is wider than the upper limit of the above range, the resulting printing medium is deteriorated in the absorption of a dye in an ink. If the half breadth is narrower than the lower limit of the above range, the resulting printing medium is deteriorated in the absorption of a solvent in an ink. Further, the total pore volume of the ink-receiving layer is preferably within a range of from 0.4 to 0.6 ml/g because ink absorbency is improved. If the pore volume of the ink receiving layer is greater than the upper limit of the above range, cracking and dusting tends to occur on the ink-receiving layer. If the pore volume is smaller than the lower limit of the above range, the resulting printing medium is deteriorated in ink absorption.

The pore volume of the ink-receiving layer is preferably at least 8 $ml/m^2$. If the pore volume is smaller than this limit, inks tend to run out of the ink-receiving layer when multicolor printing is conducted, and so bleeding occurs on an image formed. As a process for forming an ink-receiving layer having a wide pore radius distribution as described above, a process disclosed in, for example, Japanese Patent Application No. 6-114671 may be used.

In the second pore structure according to the present invention, the ink-receiving layer has at least two peaks in the pore radius distribution. The solvent component in an ink is absorbed by relatively large pores, while the dye in the ink is adsorbed by relatively small pores. The pore radius corresponding to one of the peaks is preferably smaller than 10.0 nm, more preferably within a range of from 1.0 to 6.0 nm. When the pore radius falls within this range, the resulting printing medium can quickly adsorb a dye in an ink. The pore radius corresponding to another peak is preferably within a range of from 10.0 to 20.0 nm because the ink-absorbing rate of the resulting printing medium becomes high.

If the pore radius corresponding to the former peak is larger than the above limit, the resulting printing medium is deteriorated in the adsorption and fixing of the dye in the ink, and so bleeding or feathering and beading occur on an image formed. If the pore radius corresponding to the latter peak is smaller than the lower limit of the above range, the resulting printing medium is deteriorated in the absorption of the solvent component in the ink, so that the ink is not well dried, and the surface of the ink-receiving layer remains wet even when the medium is discharged out of a printer after printing. If the pore radius corresponding to the latter peak is greater than the upper limit of the above range, the resulting ink-receiving layer tends to crack.

The total pore volume of the ink-receiving layer is preferably within a range of from 0.4 to 0.6 ml/g because the ink absorbency of the resulting printing medium is improved. If the pore volume of the ink-receiving layer is greater than the upper limit of the above range, cracking and dusting tend to occur on the ink-receiving layer. If the pore volume is smaller than the lower limit of the above range, the resulting printing medium is deteriorated in ink absorption. Further, the pore volume of the ink-receiving layer is preferably at least 8 $ml/m^2$.

If the pore volume is smaller than this limit, inks tend to run out of the ink-receiving layer, in particular, when multicolor printing is conducted, and so bleeding tends to occur on an image formed. The pore volume of pores having a pore radius not greater than 10.0 nm is preferably within a range of from 0.1 to 10% by volume, more preferably from 1 to 5% by volume based on the total pore volume because the resulting printing medium satisfies both ink absorption and dye fixing. When the pore volume of pores having a pore radius not greater than 10.0 nm falls within this range, the ink-absorbing rate and dye-adsorbing rate of the resulting printing medium become high. As a process for forming an ink-receiving layer having at least two peaks in the pore radius distribution as described above, a process disclosed in, for example, Japanese Patent Application No. 6-114669 may be used.

The following properties are common to the first and second pore structures according to the present invention.

An isothermal nitrogen adsorption and desorption curve can be obtained similarly by the nitrogen adsorption and desorption method. A relative pressure difference ($\Delta P$) between adsorption and desorption at 90 percent of the maximum amount of adsorbed gas as found from an isothermal nitrogen adsorption and desorption curve for the ink-receiving layer is preferably not larger than 0.2. As described in McBain [J. Am. Chem. Soc., Vol. 57, 699

(1935)], the relative pressure difference (ΔP) can be used as an index to whether a pore in the form of an inkpot may exist.

The pore is closer to a straight tube as the relative pressure difference (ΔP) is smaller. On the other hand, the pore is closer to an inkpot as the difference is greater. Any difference exceeding the above limit results in a recording medium lowered in absorption of an ink after printing.

The pore structure and the like of the ink-receiving layer are not determined only by the alumina hydrate, but changed by various production conditions such as the kind and mixing amount of the binder, the concentration, viscosity and dispersion state of the coating formulation, coating equipment, coating head, coating weight, and the flow rate, temperature and blowing direction of drying air. It is therefore necessary to control the production conditions within the optimum limits for achieving the intended properties of the ink-receiving layer according to the present invention.

The alumina hydrate useful in the practice of the present invention may be used with additives. The additives to be used may be freely chosen from various metal oxides, salts of divalent or still higher polyvalent metals and cationic organic substances as needed. Preferable examples of the metal oxides include oxides and hydroxides such as silica, silica-alumina, boria, silica-boria, magnesia, silica-magnesia, titania, zirconia and zinc oxide. Preferable examples of the salts of divalent or still higher polyvalent metals include calcium carbonate, barium sulfate, magnesium chloride, calcium bromide, calcium nitrate, calcium iodide, zinc chloride, zinc bromide, zinc iodide, kaolin and talc. Preferable examples of the cationic organic substances include quaternary ammonium salts, polyamines and alkylamines. The amount of the additives to be added may preferably be 20% by weight or less of the alumina hydrate.

As the binder useful in the practice of the present invention, one or more materials may be freely chosen for use from water-soluble polymers. For example, preference may be given to polyvinyl alcohol or modified products thereof, starch or modified products thereof, gelatin or modified products thereof, casein or modified products thereof, gum arabic, cellulose derivatives such as carboxymethylcellulose, conjugated diene copolymer latexes such as SBR latexes, functional group-modified polymer latexes, vinyl copolymer latexes such as ethylene-vinyl acetate copolymers, polyvinyl pyrrolidone, maleic anhydride polymers or copolymers thereof, acrylic ester copolymers, and the like.

Among these materials, a material of a structure having a hydroxyl group may preferably be used because it has a high effect on the delicate control of surface profile. The mixing ratio by weight of the alumina hydrate to the binder may be optionally selected from a range of from 5:1 to 20:1. If the amount of the binder is less than the lower limit of the above range, the mechanical strength of the resulting ink-receiving layer is insufficient, which forms the cause of cracking and dusting. If the amount is greater than the upper limit of the above range, the pore volume of the resulting ink-receiving layer is reduced, resulting in a printing medium poor in ink absorbency.

Added to the alumina hydrate and binder may optionally be dispersants for the alumina hydrate, viscosity modifiers, pH adjustors, lubricants, flowability modifiers, surfactants, antifoaming agents, water-proofing agents, foam suppressors, releasing agents, foaming agents, penetrants, coloring dyes, optical whitening agents, ultraviolet absorbents, antioxidants, antiseptics and mildewproofing agents. The water-proofing agents may be freely chosen for use from the known substances such as quaternary ammonium halides and quaternary ammonium salt polymers.

No particular limitation is imposed on the base material used for forming the ink-receiving layer thereon so far as it is a sheet-like substance, for example, a paper web such as suitably sized paper, water leaf paper or resin-coated paper making use of polyethylene or the like, or a thermoplastic film. In the case of the thermoplastic film, there may be used transparent films such as films of polyester, polystyrene, polyvinyl chloride, polymethyl methacrylate, cellulose acetate, polyethylene and polycarbonate, as well as opaque sheets opacified by the filling of a pigment or the formation of minute foams.

As a process for the production of the printing medium according to the present invention, one or more processes may desirably be chosen for use from the following processes.

In a first production process of the present invention, an aqueous dispersion containing the alumina hydrate and the binder is applied to the base material and then dried to form an ink-receiving layer. The alumina hydrate may be used in the form of either sol or powder. Since the alumina hydrate having a boehmite structure has a transition point at 160 to 250° C., the drying temperature of the coating layer is preferably not higher than this transition point. In particular, drying at a temperature ranging from 100 to 140° C. is preferable because cracking of the resulting ink-receiving layer and curling of the resulting printing medium can be prevented.

The printing medium in which the ink-receiving layer has been formed is further subjected to a heat treatment. A dot diameter ratio (D/C) of a dot diameter (D) using 30 ng of an ink containing 0.1% by weight of a surfactant to a dot diameter (C) using 30 ng of an ink containing 1.0% by weight of the surfactant when conducting printing by separately dropping inks on the printing medium becomes greater as the heat-treating temperature becomes higher, or the heat-treating time becomes longer. On the other hand, the dot diameter ratio is smaller as the heat-treating temperature becomes lower, or the heat-treating time becomes shorter.

In the present invention, the heat-treating temperature is preferably within a range of from 100 to 160° C., while the treatment time is preferably within a range of from several seconds to 1 hour. The heat-treating temperature and the heat-treating time are correlative conditions to each other. Although the above dot diameter ratio depends on the thickness and coating weight of the ink-receiving layer, the heat-treating temperature and the heat-treating time are controlled in such a manner that the dot diameter ratio falls within a range of from 1.03 to 1.08.

By presetting various conditions in such a manner that the dot diameter ratio is within the above range, all the properties of the ink-absorbing rate, dye-adsorbing capacity and index of dye-adsorbing rate can be kept within the recited ranges. If the dot diameter ratio exceeds the upper limit of the above range, the ink-absorbing rate becomes lower than the lower limit of the recited range. If the dot diameter ratio is smaller than the lower limit of the above range, the dye-adsorbing capacity and index of dye-adsorbing rate become smaller than the lower limits of the respective recited ranges. Therefore, such a great or small dot diameter ratio results in a failure to prevent the occurrence of beading.

If the heat-treating temperature or the heat-treating time exceeds the upper limit of the above range, cissing occurs upon printing on the resulting printing medium, or its ink-receiving layer is yellowed. If the heat-treating temperature or the heat-treating time is lower or shorter than the lower limit of the above range, the dye-adsorbing capacity of the resulting ink-receiving layer becomes smaller than the lower limit of the above range, the resulting printing medium undergoes curling due to environmental changes or by aging, or its ink-receiving layer becomes readily subject to cracking.

Figure 2:
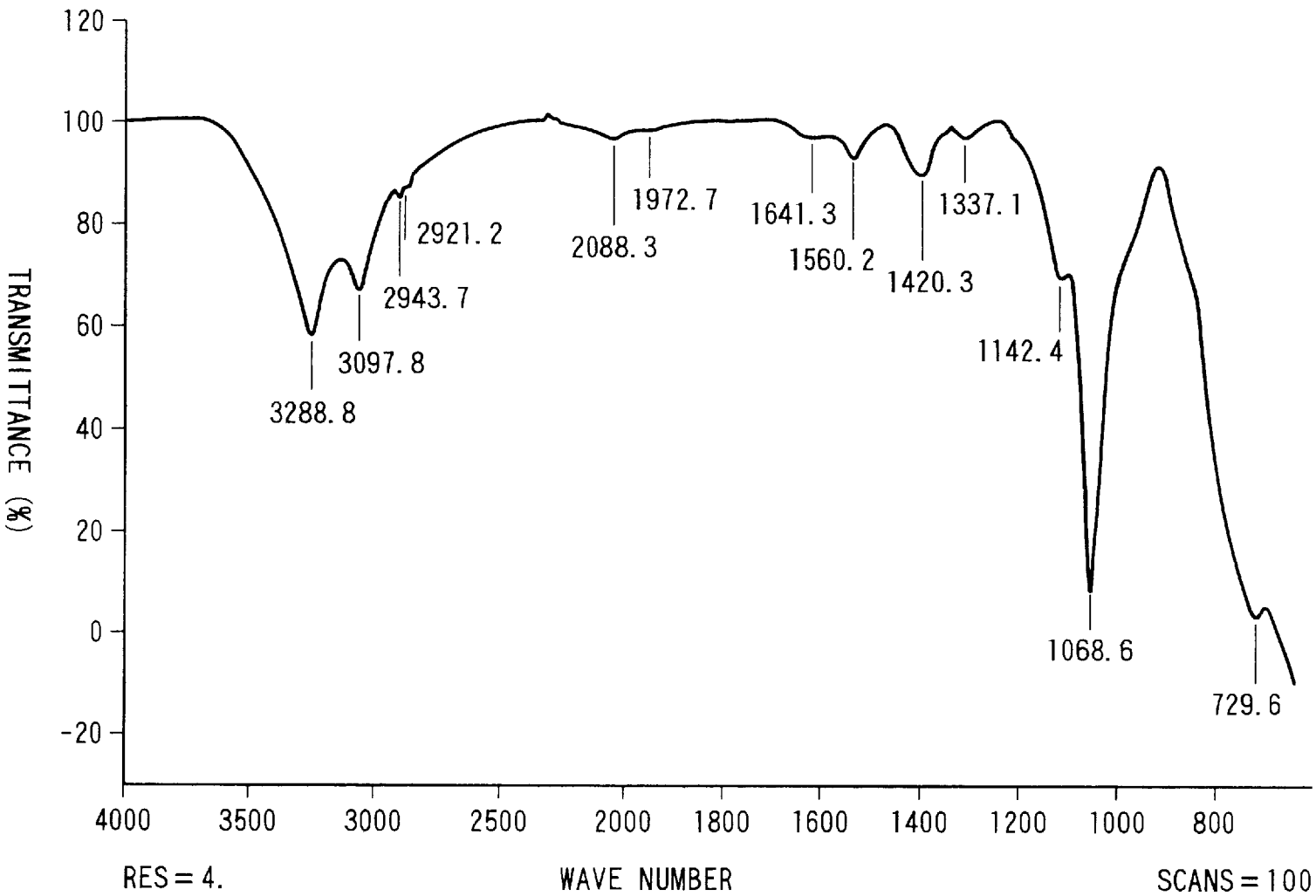
FIG. 2 illustrates an infrared transmittance of the ink-receiving layer according to Example 1 of the present invention after the heat treatment.

In Tables 2 to 7, interplanar spacing after a heat treatment are shown. FIGS. 1 and 2 illustrate infrared transmittances of an ink-receiving layer before and after the heat treatment, respectively. The interplanar spacing of the (020) plane and the crystalline size in a direction perpendicular to the (020) plane are physical quantities serving as indices to the hydrophilicity•hydrophobicity of the alumina hydrate in the ink-receiving layer and do not vary before and after the heat treatment. Japanese Pat. Application Laid-Open No. 54-42399 observes the change of state of pseudoboehmite by a heat treatment in terms of infrared absorption spectra.

In FIGS. 1 and 2, absorption near 1068 $cm^{-1}$ is attributable to boehmite, absorptions near 3288 $cm^{-1}$ and 3097 $cm^{-1}$ are attributable to a hydroxyl group, and absorption near 1641 $cm^{-1}$ is attributable to a water molecule. All of them are values serving as the indices to changes of state in the hydrophilicity•hydrophobicity and the like. However, no difference is found between these values before and after the heat treatment.

From the above results, the hydrophilicity•hydrophobicity of the ink-receiving layer does not vary even after the heat treatment. From this, it is considered that the change of the ink-receiving layer caused by the heat treatment is a delicate change, not a change of the hydrophilicity•hydrophobicity, and the surface profile of the component of the ink-receiving layer of the printing medium is slightly changed.

Alternatively, it is also considered that the surface potential of the alumina hydrate in the ink-receiving layer is slightly reduced by the heat treatment, and so its physical adsorbability and adsorbing rate to a dye or surfactant in an ink are slightly reduced, thereby preventing the formation of aggregate of the dye or surfactant and the growth of the aggregate. This slight change of state, which is not the change of the hydrophilicity-hydrophobicity, shall apply to the second and third production processes-which will be described subsequently.

The second production process is the same as in the first production process except that a metal alkoxide is added to the dispersion in the first production process, or that after an ink-receiving layer is formed in accordance with the first production process, a metal alkoxide is added to the ink-receiving layer.

Other processes for adding the metal alkoxide include a process in which after the metal alkoxide is applied to a base material, a coating formulation containing the alumina hydrate is applied, a process in which a coating formulation comprising the alumina hydrate and the metal alkoxide and a coating formulation comprising the alumina hydrate and containing no metal alkoxide are used to form an ink-receiving layer, a process in which the metal alkoxide is added to the alumina hydrate to modify the alumina hydrate for use, and a process in which the metal alkoxide is added to a coating formulation for a protective layer. No particular limitation is imposed on the process for the addition of the metal alkoxide so far as it permits the addition of the metal alkoxide. One or more processes may be chosen for use from these processes as needed.

Subsequently, the resulting printing medium is subjected to the heat treatment in the same manner as in the first production process, thereby producing a printing medium.

The heat-treating temperature and time of the ink-receiving layer are preferably within the same ranges as in the first process. The heat-treating temperature and time can be determined by a dot diameter ratio (D/C) of a dot diameter (D) of an ink containing 0.1% by weight of the same surfactant as that used in the first production process to that (C) of an ink containing 1.0% by weight of the surfactant, on a printing medium. Such conditions are controlled in such a manner that the dot diameter ratio falls within a range of from 1.04 to 1.07. So far as the dot diameter ratio is within the above range, all the properties of the ink-absorbing rate, dye-adsorbing capacity, index of dye-adsorbing rate and surfactant-adsorbing capacity can be kept within the recited ranges.

Examples of the metal alkoxide used in the present invention include methoxides, ethoxides, n-propoxides, isopropoxides, n-butoxides, sec-butoxides and tert-butoxides of aluminum, titanium, silicon and the like. One or more alkoxides may be chosen for use from these alkoxides as needed.

No particular limitation is imposed on the method for the addition of the metal alkoxide. However, it may be directly added to a dispersion of the alumina hydroxide. Alternatively, as generally used, it may be dispersed in an alcohol or another suitable solvent to apply the resultant dispersion to the ink-receiving layer. The amount of the metal alkoxide to be added should be determined by the minimum coating area and the surface area of the alumina hydrate, but must be controlled to such a degree that no difference arises between the infrared absorption spectra as described in the first production process.

In each of the case where the metal alkoxide is added to the dispersion of the alumina hydrate and the case where the metal alkoxide is impregnated into the ink-receiving layer, the amount to be added is preferably within a range of from 0.01 to 20% by weight, more preferably from 0.05 to 10% by weight based on the total weight of "the alumina hydrate and the binder". So far as the amount falls within this range, the occurrence of beading and feathering can be prevented even when printing is conducted on the resulting printing medium with inks containing a great amount of a surfactant.

If the amount exceeds the upper limit of the above range, the resulting ink-receiving layer becomes hydrophobic, and so an ink applied thereto is repelled. If the amount is less than the lower limit of the above range, on the other hand, it is impossible to delicately change the surface profile of the porous surface of the resulting ink-receiving layer, and so beading tends to occur on such an ink-receiving layer.

The third production process is the same as in the first production process except that a material capable of crosslinking a hydroxyl group (a crosslinking agent) is added to the dispersion in the first production process, or that the crosslinking agent is added to the ink-receiving layer according to the first production process.

Other processes for adding the crosslinking agent include a process in which after the crosslinking agent is applied to a base material, a coating formulation containing the alumina hydrate is applied, a process in which a coating formulation comprising the alumina hydrate and the crosslinking agent and a coating formulation comprising the alumina hydrate and containing no crosslinking agent are used to form an ink-receiving layer, a process in which the crosslinking agent is added to the alumina hydrate to modify the alumina hydrate for use, and a process in which the crosslinking agent is added to a coating formulation for a protective layer. No particular limitation is imposed on the process for the addition of the crosslinking agent so far as it permits the addition of the crosslinking agent. One or more processes may be chosen for use from these processes as needed.

Subsequently, the resulting printing medium is subjected to the heat treatment in the same manner as in the first production process, thereby producing a printing medium.

The heat-treating temperature and time of the ink-receiving layer are preferably within the same ranges as in the first process. The heat-treating temperature and time can be determined by a dot diameter ratio (D/C) of a dot diameter (D) of an ink containing 0.1% by weight of the same surfactant as that used in the first production process to that (C) of an ink containing 1.0% by weight of the surfactant, on a printing medium. Such conditions are controlled in such a manner that the dot diameter ratio falls within a range of from 1.04 to 1.07. So far as the dot diameter ratio is within the above range, all the properties of the ink-absorbing rate, dye-adsorbing capacity, index of dye-adsorbing rate and surfactant-adsorbing capacity can be kept within the recited ranges.

No particular limitation is imposed on the material capable of crosslinking a hydroxyl group (the crosslinking agent). However, examples thereof include aldehyde type materials such as formalin, acetoaldehyde, n-propylaldehyde, n-butylaldehyde, glyoxal, trifluoroacetoaldehyde and trichloroacetoaldehyde; melamine type materials such as melamine, menomethylolmelamine, dimethylolmelamine, trimethylolmelamine, pentamethylolmelamine, hexamethylolmelamine, and Sumilase Resin 613, 8% AC and 5004 (trade names, product of Sumitomo Chemical Co., Ltd.); urea type materials such as monomethylolurea, dimethylolurea, trimethylolurea, pentamethylolurea, hexamethylolurea, and SUMIREZ RESIN 614, 633, 636, 639, 703, 710 and 302 (trade names, product of Sumitomo Chemical Co., Ltd.); and amide type materials such as SUMIREZ RESIN 650, 675, 690, 5001 and 6615 (trade names, product of Sumitomo Chemical Co., Ltd.). One or more materials may be chosen for use from these crosslinking agents as needed.

No particular limitation is imposed on the method for the addition of the material capable of crosslinking a hydroxyl group. However, it may be directly added to a dispersion of the alumina hydroxide. Alternatively, as generally used, it may be dispersed in water or another suitable solvent to apply the resultant dispersion to the ink-receiving layer.

The amount of the material capable of crosslinking a hydroxyl group to be added should be determined by the minimum coating area and the surface area of the alumina hydrate, but must be controlled to such a degree that no difference arises between the infrared absorption spectra as described in the first production process. In each of the case where the crosslinking agent is added to the dispersion of the alumina hydrate and the case where the crosslinking agent is impregnated into the ink-receiving layer, the amount to be added is preferably within a range of from 0.01 to 20% by weight, more preferably from 0.05 to 10% by weight based on the total weight of "the alumina hydrate and the binder". So far as the amount falls within this range, the occurrence of beading and feathering can be prevented even when printing is conducted on the resulting printing medium with inks containing a great amount of a surfactant.

If the amount exceeds the upper limit of the above range, the resulting ink-receiving layer becomes hydrophobic, and so an ink applied thereto is repelled. If the amount is less than the lower limit of the above range on the other hand, it is impossible to delicately change the surface profile of the porous surface of the resulting ink-receiving layer, and so beading tends to occur on such an ink-receiving layer.

As a process for the dispersion treatment of the dispersion containing the alumina hydrate, any process may be chosen for use from processes routinely used in dispersion. As an apparatus to be used, a homomixer, rotary blade or the like, which makes mild stirring, is preferred to a grinder type dispersing machine such as a ball mill or sand mill. Although shearing stress varies according to the viscosity, amount and volume of a dispersion, it is preferably within a range of from 0.1 to 100.0 $N/m^2$. If strong shear force exceeding the upper limit of the above range is applied to the dispersion, the dispersion undergoes gelation, or a crystal structure is changed to an amorphous form. Shearing stress ranging from 0.1 to 20.0 $N/m^2$ is more preferable because the pore structure can be prevented from breaking so as not to reduce the pore volume.

Although the dispersing time varies according to the amount of the dispersion, the size of the container, the temperature of the dispersion, and the like, it is preferably 30 hours or shorter from the viewpoint of preventing the change of the crystal structure. When the dispersing time is 10 hours or shorter, the pore structure can be kept within the above ranges. During the dispersion treatment, the temperature of the dispersion may be kept constant by conducting cooling or heat retaining.

Although a preferable temperature range varies according to the process of the dispersion treatment, and materials and viscosity of the dispersion, it is within a range of from 10 to 100° C. If the temperature is lower than the lower limit of the above range, the dispersion treatment becomes insufficient, or aggregation occurs. If the temperature is higher than the upper limit of the above range, the dispersion undergoes gelation, or the crystal structure is changed to an amorphous form.

In the present invention, as a coating process of the dispersion comprising the alumina hydrate in the case where an ink-receiving layer is provided on a base material, there may be used a generally-used coating technique making use of a blade coater, air knife coater, roll coater, brush coater, curtain coater, bar coater, gravure coater or sprayer.

The coating weight of the dispersion is preferably within a range of from 0.5 to 60 $g/m^2$ in terms of dry solids content. When the coating weight is within the above range, the resulting printing medium can satisfy both ink absorption and absorption rate at the same time. In addition, such a printing medium can satisfy the fixing speed and quantity of a dye in an ink applied, and so feathering scarcely occurs on a printed area thereon, and the resulting image has good water fastness.

The coating weight is more preferably within a range of from 5 to 45 $g/m^2$ in terms of dry solids content. When the coating weight is within the range, cracking and curling of the resulting printing medium can be prevented. If the coat weight exceeds the upper limit of the above range, cracking tends to occur, and the ink-absorbing rate of the resulting printing media is lowered. If the coating weight is smaller than the lower limit of the above range, the ink absorption of the resulting printing medium becomes insufficient, and its index of dye-adsorbing rate is lowered.

Inks used in printing on the printing media according to the present invention comprise principally a coloring material (dye or pigment), a water-soluble organic solvent and water. Preferable examples of the dye include water-soluble dyes represented by direct dyes, acid dyes, basic dyes, reactive dyes and food colors. However, any dyes may be used so far as they provide images satisfying required performance such as fixing ability, coloring ability, brightness, stability, light fastness and the like in combination with the above-described printing media.

The water-soluble dyes are generally used by dissolving them in water or a solvent composed of water and at least one organic solvent. As a preferable solvent component for these dyes, there may be used a mixed solvent composed of water and at least one of various water-soluble organic solvents. It is however preferable to control the content of water in an ink within a range of from 20 to 90% by weight.

Examples of the water-soluble organic solvents include alkyl alcohols having 1 to 4 carbon atoms, such as methyl alcohol; amides such as dimethylformamide; ketones and keto-alcohols such as acetone; ethers such as tetrahydrofuran; polyalkylene glycols such as polyethylene glycol; alkylene glycols the alkylene moiety of which has 2 to 6 carbon atoms, such as ethylene glycol; glycerol; lower alkyl ethers of polyhydric alcohols, such as ethylene glycol methyl ether; and the like.

Among these many water-soluble organic solvents, the polyhydric alcohols such as diethylene glycol, and the lower alkyl ethers of polyhydric alcohol, such as triethylene glycol monomethyl ether and triethylene glycol monoethyl ether are preferred. The polyhydric alcohols are particularly preferred because they have an effect as a lubricant for preventing the clogging of nozzles, which is caused by the evaporation of water in an ink and hence the deposition of a water-soluble dye.

A solubilizer may be added to the inks. Nitrogen-containing heterocyclic ketones are typical solubilizers. Its object is to greatly enhance the solubility of the water-soluble dye in the solvent. For example, N-methyl-2-pyrrolidone, 1,3-dimethyl-2-imidazolidinone are preferably used. In order to further improve the properties of inks, additives such as viscosity modifiers, surfactants, surface tension modifiers, pH adjustors and resistivity regulative agents may be added.

A method for conducting printing by applying the above-described inks to the printing medium is an ink-jet print method. As such a method, any system may be used so far as it can effectively eject an ink out of a nozzle to apply it to the printing medium. In particular, an ink-jet recording system described in Japanese Patent Application Laid-Open No. 54-59936, in which an ink undergoes a rapid volumetric change by an action of thermal energy applied to the ink, so that the ink is ejected out of a nozzle by the working force generated by this change of state, may be used effectively.

The prior art cited above and the present invention have been investigated in comparison with each other. As a result, differences therebetween are as follows:

1. The present invention relates to a printing medium in which the ink-absorbing rate, dye-adsorbing capacity and index of dye-adsorbing rate of an ink-receiving layer to an ink containing 0.1% by weight of a surfactant are adjusted within the specified ranges. The printing medium has an effect of preventing the occurrence of beading when conducting printing with inks containing a surfactant. By adjusting the surfactant adsorption of the ink-receiving layer within the specified range, the printing medium has an additional effect of preventing the occurrence of beading even when conducting printing with inks containing 1 to 10% by weight of a surfactant. The prior art does not disclose anything about the method for preventing the occurrence of beading when conducting printing with an ink containing the surfactant or an ink containing a high portion of the surfactant.

2. The prior art discloses a printing medium in which the porous structure, such as pore radius distribution and pore volume, of an ink-receiving layer are adjusted to increase its ink-absorbing rate and ink absorption quantity. The prior art also discloses a printing medium in which a resin material having high solvent absorbency is used in an ink-receiving layer, or a surfactant is added to an ink-receiving layer, thereby enhancing its ink-absorbing rate and ink absorption quantity. These are based on an idea that the ink-absorbing rate of the ink-receiving layer is enhanced, thereby preventing the occurrence of beading due to the growth of ink droplets on the surface of the ink-receiving layer. However, they do not describe anything about the fixing of a dye in the ink absorbed in the interior of the ink-receiving layer and prevention of its aggregation. Further, these documents do not describe the measures for the beading caused by inks containing a surfactant.

On the other hand, the present invention is based on an idea that a printing medium in which the ink absorption properties, dye-adsorbing capacity and index of dye-adsorbing rate of an ink-receiving layer to an ink containing a surfactant are within the specified ranges is used to prevent the occurrence of beading. According to the present invention, when a transparent base material is used, there can be provided an image on which no beading in the interior of the ink-receiving layer is observed even when observing from the side of the base material. Further, the present invention has an advantage that little difference arises in optical density and coloring of the image between the observation from the side of the ink-receiving layer and the observation from the side of the base material or between the observation by reflection and the observation by transmission.

3. The prior art discloses a printing medium using a dye-adsorbing material or a material having a dye-adsorbing capacity which falls within a specified range. This is based on an idea that the adsorption of a dye in an ink is improved to improve the water fastness of an image printed thereon. However, although the dye-absorbing capacity and index of dye-adsorbing rate strongly depend on not only the physical properties of materials used, such as pigments and resins, but also the dry solids content, thickness and specific surface area of the ink-receiving layer formed, the prior art does not describe this fact. The prior art also does not describe anything about the measures for beading caused by inks containing a surfactant.

On the other hand, the present invention is based on an idea that the properties of the ink-receiving layer, i.e., ink-absorbing time, dye-adsorbing capacity and index of dye-adsorbing rate when conducting printing with inks containing a surfactant are adjusted within the specified ranges, thereby preventing the occurrence of beading. This idea is not disclosed in the prior art.

4. The prior art discloses a printing medium in which a hydrophobic substance is added to an ink-receiving layer, or the surface of an ink-receiving layer is made hydrophobic. This method is based on an idea that the ink-receiving layer is rendered hydrophobic, thereby controlling a contact angle between the printing medium and ink droplets upon wetting to prevent ink droplets ejected from spreading into greater droplets, so that beading is prevented. However, the prior art does not describe anything about the measures for beading caused by inks containing a surfactant.

On the other hand, according to the present invention, a porous ink-receiving layer is formed on a base material and then subjected to a heat treatment or the like, thereby delicately changing the surface profile of the porous material in the ink-receiving layer, so that the properties of the ink-receiving layer, i.e., ink-absorbing rate, dye-adsorbing capacity and index of dye-adsorbing rate are satisfied. This idea is not disclosed in the prior art. In the present invention, a metal alkoxide or a material capable of crosslinking a hydroxyl group is further used. In this case, the hydrophilicity•hydrophobicity of the ink-receiving layer does not vary even after the heat treatment. The idea that the occurrence of beading is prevented by this delicate change of the surface profile is not described in the prior art.

The present invention will hereinafter be described more specifically by the following Examples. However, the present invention is not limited to these examples. The measurements of various properties as described herein were conducted by the following apparatus, inks and methods. Incidentally, all designations of "part" or "parts" as will be used in the following examples mean part or parts by weight unless expressly noted.

[A: Printing apparatus]

Using an ink-jet printer equipped with four drop-on-demand type ink-jet heads for yellow (Y), magenta (M), cyan (C) and black (Bk) inks, each of which has 128 nozzles at intervals of 16 nozzles per mm and ejects an ink by applying thermal energy, in which the head is scanned in a direction perpendicular to a nozzle line to conduct printing, ink-jet printing was performed with inks having their corresponding compositions described below with each of the inks ejected in a proportion of 30 ng per dot.

The quantities of ink in single-color printing of 16×16 dots per $mm^2$ were determined as 100%, in two-color printing as 200%, in three-color printing as 300% and in four-color printing as 400%.

Further, printing was performed continuously in an ink quantity of from 100% to 400% to overlap each other, whereby printing was conducted in the ink quantity up to 800%.

[B: Dyes for inks]

Y: C.I. Direct Yellow 86
M: C.I. Acid Red 35
C: C.I. Direct Blue 199
Bk: C.I. Food Black 2.

[C: Surfactant]

Surfynol 465 (trade name, product of Nisshin Chemical Industry Co., Ltd.).

[D: Ink Composition 1; single-color ink]

| | |
|---|---|
| Dye | 3 parts |
| Surfactant | 0.1 part |
| Diethylene glycol | 5 parts |
| Polyethylene glycol | 10 parts |
| Deionized water | Balance |
| Total | 100 parts. |

[E: Ink Composition 2; single-color ink]

| | |
|---|---|
| Dye | 3 parts |
| Surfactant | 1.0 part |
| Diethylene glycol | 5 parts |
| Polyethylene glycol | 10 parts |
| Deionized water | Balance |
| Total | 100 parts. |

[F: Ink Composition 3; clear ink]

| | |
|---|---|
| Surfactant | 1.0 part |
| Diethylene glycol | 5 parts |
| Polyethylene glycol | 10 parts |
| Deionized water | Balance |
| Total | 100 parts. |

[1. Ink-absorbing Time]

The black ink of Ink Composition 1 was used to eject 30 ng of the ink as a dot on one point of a printing medium sample by means of the above printing apparatus. The process of ink absorption at this point was observed through a microscope to determine the time required to absorb the ink. Besides, using the same apparatus, solid printing was conducted in ink quantities of 100% and 200%, thereby measuring the ink-absorbing time.

[2. Dye-adsorbing Capacity]

The black ink of Ink Composition 1 was used to conduct solid printing by means of the above printing apparatus on a 2×3 cm area of a printing medium sample with the quantity of the ink varied from 100% to 800%. The thus-printed medium was left to stand at room temperature until it was completely dried, and then immersed in 1 liter of deionized water to determine whether the dye ran out of the printed area. An ink quantity in which the dye did not run out was determined to calculate the maximum amount of the dye adsorbed from this ink quantity.

Besides, the dye adsorption quantity of an alumina hydrate sample was measured in accordance with the method described in Japanese Patent Application Laid-Open No. 1-97678.

[3. Index of Dye-adsorbing Rate]

Using the above printing apparatus and clear ink of Ink Composition 3, printing was conducted on a printing medium sample with the quantity of the ink varied from 100% to 400%. Using the black ink of Ink Composition 1 and the same printing apparatus, 30 ng of the ink were ejected as a dot on one point of the thus-printed medium to conduct one-dot printing. The printing medium thus printed was completely dried at room temperature. The diameter of the printed dot was measured through a microscope equipped with a 20 magnification objective. A ratio of the dot diameter of the printing medium printed with the clear ink to the dot diameter of the printing medium not printed with the clear ink was found, and the value thus obtained was multiplied by 100. The quantity of the clear ink applied within limits not causing ink feathering and the value obtained by multiplying the ratio between the dot diameters by 100 were plotted. This relationship is regarded as a linear function to determine a slope. This slope was determined as the index of dye-adsorbing rate.

[4. Surfactant-adsorbing Capacity]

Using the above printing apparatus and clear ink of Ink Composition 3, printing was conducted on a printing medium sample with the quantity of the ink varied from 100% to 400%. Right after the printing, the printed area was observed visually, thereby determining a maximum quantity of the clear ink within limits for the printed area not to become opaque white. The surfactant-adsorbing capacity was found from this maximum quantity of the ink printed.

[5. Dot Diameter and Dot Diameter Ratio]

Using the above printing apparatus and black inks of Ink Compositions 1 and 2, 30 ng of each of the inks were ejected as a dot on one point of a printing medium sample to conduct one-dot printing. The printing medium thus printed was completely dried at room temperature. The diameters of the respective printed dots were measured through a microscope equipped with an objective of 20 magnifications to determine a ratio between the diameters.

[6. Dye-adsorbing Capacity Ratio]

Using the black ink of Ink Composition 2, the dye-absorbing capacity of a printing medium sample was determined in the same manner as in the determination of dye-adsorbing capacity in the item 2.

A ratio of the dye-adsorbing capacity as to the ink of Ink Composition 2 to the dye-adsorbing capacity as to the ink of Ink Composition 1 was found to determine the value as a dye-adsorbing capacity ratio.

[7. Ink absorbency: Ink Absorbency upon Multi-color Printing]

Using the yellow, magenta, cyan and black inks of Ink Compositions 1 and 2, single-color or multi-color solid printing was conducted on a printing medium sample by means of the above printing apparatus with the ink quantity varied from 100% (a single color) to 400% (four colors). Right after the printing, the drying condition of the inks on the surface of the printing medium sample printed was determined by touching the printed area with a finger. The quantity of each ink in the single-color printing was determined as 100%. The ink absorbency was ranked as "A" where no ink adhered to the finger in an ink quantity of 300%, "B" where no ink adhered to the finger in an ink quantity of 100%, or "C" where some ink adhered to the finger in an ink quantity of 100%.

[8. Optical Density and Coloring]

Using the yellow, magenta, cyan and black inks of Ink Compositions 1 and 2, solid printing was conducted on a printing medium sample, in which an ink-receiving layer had been provided on a base material, by means of the above printing apparatus in an ink quantity of 100% (a single color). The optical density of the image formed with each color ink was measured from the side of the ink-receiving layer by means of a Macbeth reflection densitometer RD-918.

In the case of a printing medium sample in which a transparent base material was used, paper for electrophotography (EW-500, trade name, product of Canon Inc.) was overlapped with the surface of the printing medium sample, on which no ink-receiving layer was provided, to perform the measurement.

On the other hand, the black inks of Ink Compositions 1 and 2 were used to conduct solid printing on a printing medium sample, in which a transparent base material was used, in the same manner as described above. The images thus printed were visually observed from both sides of the ink-receiving layer and the base material. In this test, the sample was ranked as "A" where no difference in optical density and coloring of the image between the observation from the ink-receiving layer side and the observation from the base material side was recognized, "B" where a difference in either optical density or coloring of the image between them was recognized, or "C" where a difference in both optical density and coloring of the image between them was recognized.

[9. Feathering, Cissing and Beading]

Using the yellow, magenta, cyan and black inks of Ink Compositions 1 and 2, single-color or multi-color solid printing was conducted on a printing medium sample, in which an ink-receiving layer had been provided on a base material, by means of the above printing apparatus with the ink quantity varied from 100% (a single color) to 400% (four colors). The printing medium sample thus printed was visually observed from both sides of the ink-receiving layer and the base material as to whether feathering, cissing and beading occurred. The resistance to feathering, cissing or beading of the printing medium sample was ranked as "A" where feathering, cissing or beading did not occur in an ink quantity of 300%, "B" where feathering, cissing or beading did not occur in an ink quantity of 100%, or "C" where feathering, cissing or beading occurred in an ink quantity of 100%.

[10. Interplanar Spacing of (020) Plane and Crystalline]size in a Direction Perpendicular to (020) Plane A sample was placed on a sample carrier with a sample cell when the sample was powder, or in the form of a sheet as it was when the sample was a printing medium.

X-Ray diffractometer: RAD-2R (manufactured by RIGAKU CORPORATION)

Target: CuKα

Optical system: wide angle goniometer (equipped with a graphite curved monochromator)

Gonio-radius: 185 mm

Slit: DS 1°, RS 1°, SS 0.15 mm

Lamp voltage and current of X-ray source: 40 kV and 30 mA.

Measurement conditions: 2θ-θ method measured by (2θ= continuous scan every 0.002°, 2θ=10° to 30°, 1°/min).

The interplanar spacing was determined in accordance with Bragg's formula $$d=\lambda/2\sin\theta \quad \text{(Formula I).}$$

The crystalline size was determined in accordance with Scherrer's formula $$E=0.9\lambda/B\cos\theta \quad \text{(Formula II).}$$

In the above formulae, λ is a wavelength of the X-ray, 2θ is a diffraction angle at a peak, and B is a half breadth at a peak.

[11. BET Specific Surface Area, Pore Radius Distribution, Pore Volume and Isothermal Adsorption and Desorption Curve Characteristics]

After a printing medium sample was thoroughly heated and deaerated, measurement was conducted using the nitrogen adsorption and desorption method.

Measuring apparatus: Autosorb 1 (trade name, manufactured by Quanthachrome Co.).

The BET specific surface area was calculated in accordance with the method of Brunauer, et al. [J. Am. Chem. Soc., Vol. 60, 309 (1938)].

The pore radius and pore volume were calculated in accordance with the method of Barrett, et al. [J. Am. Chem. Soc., Vol. 73, 373 (1951)].

A relative pressure difference (ΔP) between adsorption and desorption at 90 percent of the maximum amount of adsorbed gas was found from an isothermal nitrogen adsorption and desorption curve.

12. Quantitative Analysis of Titanium Dioxide

The content of titanium dioxide in an alumina hydrate sample was determined by fusing the alumina hydrate sample in a borate in accordance with the ICP method (SPS 4000, trade name, manufactured by Seiko-Electronic Inc.).

The distribution of titanium dioxide in the alumina hydrate sample was analyzed by means of an ESCA (Model 2803, manufactured by Surface Science Instruments Co.). The surface of the alumina hydrate sample was etched with an argon ion for 100 seconds and 500 seconds to determine the change in content of the titanium dioxide.

13. Measurement of Infrared Transmittance

Measurement was conducted using the FT-IR method. The transmittance of an ink-receiving layer of a printing medium sample was measured in accordance with the ATR method.

Measuring apparatus: FTS-65A (trade name, manufactured by Nippon Bio Rad Laboratory Co. Ltd.)

ATR conditions: ZnSe crystal/45°, detector: MCT.

[14. Shape of Particle]

An alumina hydrate sample was dispersed in deionized water, and the resultant dispersion was dropped on a collodion membrane to prepare a sample for measurement. This sample was observed through a transmission type electron microscope (H-500, manufactured by Hitachi Ltd.) to determine an aspect ratio, slenderness ratio and particle shape.

[15. Transparency]

The haze degree of a printing medium sample, in which an alumina hydrate dispersion was applied to a transparent PET film, was measured by means of a hazeometer NDH-1001DP (trade name, manufactured by Nippon Denshoku K. K.) in accordance with JIS K-7105.

[16. Resistance to Cracking]

The length of cracks occurred on a printing medium sample, in which an alumina hydrate dispersion was applied to a transparent PET film, was visually measured. The resistance to cracking of the sample was ranked as "A" where there was no crack not shorter than 1 mm, "B" where there was no crack not shorter than 5 min, or "C" where there was a crack longer than 5 mm.

[17. Resistance to Curling]

A printing medium sample was cut into a size of 297 by 210 mm and placed on a flat table to measure the height of warpage by a height gage. The resistance to curling of the sample was ranked as "A" where the height was not more than 1 mm, "B" where the height was not more than 3 mm, or "C" where the height was more than 3 mm.

[18. Tack-free Property]

The surface of a printing medium sample was touched with a finger to rank the tack-free property of the sample as "A" where it was not tacky to the touch, or "C" where it was tacky to the touch.

Synthetic Examples 1 and 2 of Alumina Hydrate

Aluminum dodeoxide was prepared in accordance with the process described in U.S. Pat. No. 4,242,271. The aluminum dodeoxide was then hydrolyzed in accordance with the process described in U.S. Pat. No. 4,202,870 to prepare an alumina slurry. Water was added to the alumina slurry until the solids content of alumina hydrate was 7.9%. The pH of the alumina slurry was 9.5. A 3.9% nitric acid solution was added to adjust the pH of the slurry.

Colloidal sols of alumina hydrate were obtained under their corresponding aging conditions shown in Table 1. Each of these colloidal sols of alumina hydrate was spray-dried at an inlet temperature of 120° C. to obtain its corresponding alumina hydrate powder. The crystal structure of the alumina hydrate was boehmite, and its particle shape was in the form of a flat plate. The physical property values of the resulting alumina hydrates were determined in accordance with the respective methods described above. The results of the measurement are shown in Table 1.

Synthetic Examples 3 and 4 of Alumina Hydrate

Aluminum dodeoxide was prepared in the same manner as in Synthetic Examples 1 and 2. The aluminum dodeoxide was then hydrolyzed in the same manner as in Synthetic Examples 1 and 2 to prepare an alumina slurry. The aluminum dodeoxide and isopropyltitanium (product of Kishida Chemical Co., Ltd.) were mixed at a mixing ratio by weight of 100:5. Using the alumina slurry as a nucleus for crystal growth, the mixture was hydrolyzed in the same manner as in Synthetic Examples 1 and 2 to prepare a titanium dioxide-containing alumina slurry. Water was added to the alumina slurry until the solids content of alumina hydrate was 7.9%. The pH of the alumina slurry was 9.5. A 3.9% nitric acid solution was added to adjust the pH of the slurry.

Colloidal sols of alumina hydrate were obtained under their corresponding aging conditions shown in Table 1. Each of these colloidal sols of alumina hydrate was spray-dried in the same manner as in Synthetic Examples 1 and 2 to obtain its corresponding alumina hydrate. As with those obtained in Synthetic Examples 1 and 2, the alumina hydrate had a boehmite structure, and its particle shape was in the form of a flat plate. The physical property values of the resulting alumina hydrates were determined in accordance with the respective methods described above. The results of the measurement are shown in Table 1. Titanium dioxide existed only in the vicinity of the surface of the alumina hydrate.

Synthetic Example 5 of Alumina Hydrate

An alumina sol was prepared in accordance with Comparative Example 1 of Japanese Patent Application Laid-Open No. 5-32414. The alumina sol was spray-dried in the same manner as in Synthetic Examples 1 and 2 to obtain an alumina hydrate. The alumina hydrate had a boehmite structure, and its particle shape was in the form of a needle. The results of the measurement are shown in Table 1.

TABLE 1

| Aging conditions and measurement results | Syn. Ex. 1 | Syn. Ex. 2 | Syn. Ex. 3 | Syn. Ex. 4 | Syn. Ex. 5 |
|---|---|---|---|---|---|
| pH before aging | 5.9 | 7.2 | 6.0 | 7.0 | — |
| Aging temperature (° C.) | 163 | 51.5 | 168 | 53.5 | — |
| Aging period | 3.7 hours | 9.5 days | 4.3 hours | 9.5 days | — |
| Aging apparatus | Autoclave | Oven | Autoclave | Oven | — |
| Titanium dioxide content (ICP, % by weight) | — | — | 0.150 | 0.150 | — |
| Titanium dioxide content (ESCA, % by weight) After surface etching | — | — | 0.110 | 0.1101 | — |
| 100 sec | — | — | 0.051 | 0.051 | — |
| 500 sec | — | — | 0.000 | 0.000 | — |
| Particle shape | Plate | Plate | Plate | Plate | Needle |
| Average particle size (nm) | 28.0 | 30.0 | 24.0 | 27.0 | 20.0 |
| Aspect ratio | 6.6 | 8.4 | 5.6 | 8.0 | 3.0 |
| Spacing (nm) | 0.618 | 0.619 | 0.618 | 0.619 | 0.619 |
| crystalline size (nm) | 8.2 | 7.3 | 7.4 | 7.4 | 6.7 |
| Dye-adsorbing capacity (mg/g) | <0.01 | <0.01 | <0.01 | <0.01 | <0.01 |

Examples 1 and 2

Polyvinyl alcohol (Gohsenol NH18, trade name, product of The Nippon Synthetic Chemical Industry Co., Ltd.) was dissolved or dispersed in deionized water to obtain a solution or dispersion in a solids concentration of 10% by weight. The alumina hydrate obtained in Synthetic Example 1 was similarly dispersed in deionized water to obtain a dispersion in a solids concentration of 15% by weight. The alumina hydrate dispersion and the polyvinyl alcohol dispersion were weighed out so as to give a weight ratio of 10:1 in terms of solids and mixed with each other while stirring for 30 minutes at 8,000 rpm by means of a homomixer (manufactured by Tokushu Kika Kogyo Co., Ltd.), thereby obtaining a mixed dispersion.

The mixed dispersion was applied by a die coating process onto a PET film (Lumirror, trade name, product of Toray Industries, Inc.) having a thickness of 100 $\mu$m. The PET film on which the mixed dispersion had been coated was placed into an oven (manufactured by YAMATO SCIENTIFIC CO., LTD.) to heat and dry it at 100° C. for 10 minutes, thereby obtaining a printing medium in which an ink-receiving layer having a thickness of 30 μm was formed. The thus-obtained printing medium was further subjected to a heat treatment for 10 minutes under its corresponding temperature conditions shown in Table 2 in the same oven. The physical property values and printability of the printing media are shown in Table 2.

Examples 3 and 4

An ethanol dispersion of aluminum isopropoxide (product of Kawaken Fine Chemicals Co., Ltd.) was added to the same mixed dispersion as that used in Example 1 in amounts of 5% by weight and 10% by weight in terms of solids, respectively, based on the solids content of the respective mixed dispersions. Each of the thus-obtained mixed dispersions was used to produce a printing medium in the same manner as in Example 1 except that the resulting printing medium was subjected to a heat treatment under its corresponding temperature conditions shown in Table 3. The physical property values and printability of the printing media are shown in Table 3.

Examples 5 and 6

After ink-receiving layers were formed in the same manner as in Example 1, the same ethanol dispersion of aluminum isopropoxide as that used in Examples 3 and 4 was applied to the ink-receiving layers in amounts of 5% by weight and 10% by weight, respectively, based on the solids content of the ink receiving layers. The subsequent steps were conducted in the same manner as in Example 1 except that the resulting printing media were subjected to a heat treatment under their corresponding temperature conditions shown in Table 3. The physical property values and printability of the printing media are shown in Table 3.

Examples 7 and 8

Printing media were produced in the same manner as in Examples 3 and 4 except that a melamine resin (SUMIREZ RESIN 613 Special, trade name, product of Sumitomo Chemical Co., Ltd.) was used in place of the ethanol dispersion of aluminum isopropoxide. The physical property values and printability of the printing media are shown in Table 4.

Examples 9 and 10

Printing media were produced in the same manner as in Examples 5 and 6 except that the same melamine resin as that used in Examples 7 and 8 was used in place of the ethanol dispersion of aluminum isopropoxide. The physical property values and printability of the printing media are shown in Table 4.

Examples 11 to 14

The alumina hydrates obtained in Synthetic Examples 2 to 5 were used and separately dispersed in deionized water to obtain dispersions in a solids concentration of 15% by weight. Printing media were produced in the same manner as in Example 1 except that the thus-obtained dispersions were separately used in place of the dispersion of Example 1. The printing media were subjected to a heat treatment at 120° C. for 10 minutes in the same manner as in Example 1. The physical property values and printability of the printing media are shown in Table 5.

Examples 15 to 18

The alumina hydrates obtained in Synthetic Examples 2 to 5 were used and separately dispersed in deionized water to obtain dispersions in a solids concentration of 15% by weight. The same polyvinyl alcohol as that used in Example 1 was used and weighed out so as to give the same mixing ratio in terms of solids as in Example 1, thereby obtaining respective mixed dispersions. The same melamine resin as that used in Example 7 was added to the mixed dispersions in an amount of 10% by weight in terms of solids based on the solids content of each of the mixed dispersions. Each of the thus-obtained mixed dispersions was stirred in the same manner as in Example 1, and the same base material as that used in Example 1 was coated with the mixed dispersion and dried in the same manner as in Example 1, thereby obtaining a printing medium in which an ink-receiving layer having a thickness of 30 μm was formed. The thus-obtained printing medium was further subjected to a heat treatment at 100° C. for 10 minutes by means of the same apparatus as that used in Example 1. The physical property values and printability of the printing media are shown in Table 6.

Examples 19 to 22

The alumina hydrates obtained in Synthetic Examples 2 to 5 were used and separately dispersed in deionized water to obtain dispersions in a solids concentration of 15% by weight. The same polyvinyl alcohol as that used in Example 1 was used and weighed out so as to give the same mixing ratio in terms of solids as in Example 1, thereby obtaining respective mixed dispersions. The same base materials as that used in Example 1 were coated with the respective dispersions and dried in the same manner as in Example 1, thereby obtaining printing media in which an ink-receiving layer having a thickness of 30 μm was formed. The same melamine resin as that used in Example 7 was added to each of the ink-receiving layers of the printing media in an amount of 10% by weight in terms of solids based on the solids content of the ink-receiving layer. The thus-treated printing medium was further subjected to a heat treatment at 100° C. for 10 minutes by means of the same apparatus as that used in Example 1. The physical property values and printability of the printing media are shown in Table 7.

TABLE 2

| Production conditions and item determined | Ex. 1 | Ex. 2 |
|---|---|---|
| Alumina hydrate | Syn. Ex. 1 | Syn. Ex. 1 |
| Amount of additive (% by weight) | None | None |
| Heat treatment temperature (° C.) | 120 | 140 |
| Interplanar spacing of (020) plane (nm) | 0.618 | 0.618 |
| Crystalline size of (020) plane (nm) | 7.5 | 7.5 |
| BET specific surface area ($m^2/g$) | 160 | 160 |
| Average pore radius (nm) | 7.0 | 7.0 |
| Half breadth (nm) | 3.5 | 3.5 |
| Peak 1 of pore distribution (nm) | 7.0 | 7.0 |
| Peak 2 of pore distribution (nm) | — | — |
| Pore volume (ml/g) | 0.60 | 0.60 |
| (ml/$m^2$) | 9.4 | 9.4 |

TABLE 2-continued

| Production conditions and item determined | | Ex. 1 | Ex. 2 |
|---|---|---|---|
| Pore volume ratio of peak 2 (%) | | — | — |
| Relative pressure difference (ΔP) | | 0.04 | 0.04 |
| Ink-absorbing time (msec) | | | |
| (Ink 1) | (1 dot) | 200 | 200 |
| | (100%) | 200 | 200 |
| | (200%) | 400 | 400 |
| Ink-absorbing time (msec) | | | |
| (Ink 2) | (1 dot) | 600 | 600 |
| | (100%) | 600 | 600 |
| | (200%) | 1200 | 1200 |
| Dye-adsorbing capacity (Ink 1, mg/m$^2$) | | 1200 | 1500 |
| Dye-adsorbing capacity ratio | | 0.8 | 1.0 |
| Index of dye-adsorbing rate | | 4.5 | 3.2 |
| Surfactant-adsorbing capacity (mg/m$^2$) | | 200 | 250 |
| Dot diameter | | | |
| (Ink 1, μm) | | 91 | 92 |
| (Ink 2, μm) | | 88 | 89 |
| Dot diameter ratio | | 1.03 | 1.03 |
| Ink absorbency (Ink 1) | | A | A |
| Ink absorbency (Ink 2) | | A | A |
| Optical density (Ink 1) | | | |
| | (Y) | 1.95 | 1.95 |
| | (M) | 1.88 | 1.93 |
| | (C) | 1.05 | 1.97 |
| | (Bk) | 2.00 | 2.05 |

TABLE 2-continued

| Production conditions and item determined | | Ex. 1 | Ex. 2 |
|---|---|---|---|
| Optical density (Ink 2) | | | |
| | (Y) | 1.85 | 1.87 |
| | (M) | 1.80 | 1.83 |
| | (C) | 1.85 | 1.84 |
| | (Bk) | 1.89 | 1.88 |
| Observation of optical density from both sides | | | |
| | (Ink 1) | A | A |
| | (Ink 2) | B | B |
| Feathering | | | |
| (Ink 1, receiving layer side) | | A | A |
| (Ink 1, base material side) | | A | A |
| (Ink 2, receiving layer side) | | B | B |
| (Ink 2, base material side) | | B | B |
| Beading | | | |
| (Ink 1, receiving layer side) | | A | A |
| (Ink 1, base material side) | | A | A |
| (Ink 2, receiving layer side) | | B | B |
| (Ink 2, base material side) | | B | B |
| Cissing | | | |
| (Ink 1, receiving layer side) | | A | A |
| (Ink 1, base material side) | | A | A |
| (Ink 2, receiving layer side) | | B | B |
| (Ink 2, base material side) | | B | B |
| Haze degree | | 4.0 | 4.0 |
| Resistance to cracking | | A | A |
| Resistance to curling | | A | A |
| Tack-free property | | A | A |

TABLE 3

| Production conditions and item determined | | Ex. 3 | Ex. 4 | Ex. 5 | Ex. 6 |
|---|---|---|---|---|---|
| Alumina hydrate | | Syn. Ex. 1 | Syn. Ex. 1. | Syn. Ex. 1 | Syn. Ex. 1 |
| Amount of additive (% by weight) | | 5 | 10 | 5 | 10 |
| Heat treatment temperature (° C.) | | 120 | 100 | 120 | 100 |
| Interplanar spacing of (020) plane (nm) | | 0.618 | 0.618 | 0.618 | 0.618 |
| Crystalline size of (020) plane (nm) | | 7.5 | 7.5 | 7.5 | 7.5 |
| BET specific surface area (m$^2$/g) | | 140 | 140 | 140 | 140 |
| Average pore radius (nm) | | 7.0 | 7.0 | 7.0 | 7.0 |
| Half breadth (nm) | | 3.5 | 3.5 | 3.5 | 3.5 |
| Peak 1 of pore distribution (nm) | | 7.0 | 7.0 | 7.0 | 7.0 |
| Peak 2 of pore distribution (nm) | | — | — | — | — |
| Pore volume | (ml/g) | 0.60 | 0.60 | 0.60 | 0.60 |
| | (ml/m$^2$) | 9.4 | 9.4 | 9.4 | 9.4 |
| Pore volume ratio of peak 2 (%) | | — | — | — | — |
| Relative pressure difference (ΔP) | | 0.04 | 0.04 | 0.04 | 0.04 |

TABLE 3-continued

| Production conditions and item determined | | Ex. 3 | Ex. 4 | Ex. 5 | Ex. 6 |
|---|---|---|---|---|---|
| Ink-absorbing time (msec) | | | | | |
| (Ink 1) | (1 dot) | 200 | 200 | 200 | 200 |
| | (100%) | 200 | 200 | 200 | 200 |
| | (200%) | 400 | 400 | 400 | 400 |
| Ink-absorbing time (msec) | | | | | |
| (Ink 2) | (1 dot) | 200 | 200 | 200 | 200 |
| | (100%) | 200 | 200 | 200 | 200 |
| | (200%) | 400 | 400 | 400 | 400 |
| Dye-adsorbing capacity | | | | | |
| (Ink 1, mg/m$^2$) | | 1250 | 1450 | 1200 | 1300 |
| Dye-adsorbing capacity ratio | | 0.7 | 0.9 | 0.9 | 1.2 |
| Index of dye-adsorbing rate | | 4.0 | 3.2 | 4.9 | 2.0 |
| Surfactant-adsorbing capacity (mg/m$^2$) | | 750 | 800 | 720 | 750 |
| Dot diameter | | | | | |
| (Ink 1, $\mu$m) | | 93 | 89 | 93 | 90 |
| (Ink 2, $\mu$m) | | 89 | 84 | 88 | 86 |
| Dot diameter ratio | | 1.04 | 1.06 | 1.05 | 1.05 |
| Ink absorbency (Ink 1) | | A | A | A | A |
| Ink absorbency (Ink 2) | | A | A | A | A |
| Optical density (Ink 1) | | | | | |
| | (Y) | 1.91 | 1.93 | 1.90 | 1.93 |
| | (M) | 1.91 | 1.90 | 1.93 | 1.89 |
| | (C) | 1.93 | 1.95 | 1.91 | 1.95 |
| | (Bk) | 1.99 | 2.03 | 1.99 | 1.99 |
| Optical density (Ink 2) | | | | | |
| | (Y) | 1.89 | 1.87 | 1.86 | 1.87 |
| | (M) | 1.88 | 1.83 | 1.88 | 1.84 |
| | (C) | 1.91 | 1.84 | 1.82 | 1.85 |
| | (Bk) | 1.95 | 1.88 | 1.90 | 1.89 |
| Observation of optical density from both sides | | | | | |
| (Ink 1) | | A | A | A | A |
| (Ink 2) | | A | A | A | A |
| Feathering | | | | | |
| (Ink 1, receiving layer side) | | A | A | A | A |
| (Ink 1, base material side) | | A | A | A | A |
| (Ink 2, receiving layer side) | | A | A | A | A |
| (Ink 2, base material side) | | A | A | A | A |
| Beading | | | | | |
| (Ink 1, receiving layer side) | | A | A | A | A |
| (Ink 1, base material side) | | A | A | A | A |
| (Ink 2, receiving layer side) | | A | A | A | A |
| (Ink 2, base material side) | | A | A | A | A |
| Cissing | | | | | |
| (Ink 1, receiving layer side) | | A | A | A | A |
| (Ink 1, base material side) | | A | A | A | A |
| (Ink 2, receiving layer side) | | A | A | A | A |
| (Ink 2, base material side) | | A | A | A | A |
| Haze degree | | 4.0 | 4.0 | 4.0 | 4.0 |
| Resistance to cracking | | A | A | A | A |
| Resistance to curling | | A | A | A | A |
| Tack-free property | | A | A | A | A |

TABLE 4

| Production conditions and item determined | Ex. 7 | Ex. 8 | Ex. 9 | Ex. 10 |
|---|---|---|---|---|
| Alumina hydrate | Syn. Ex. 1 | Syn. Ex. 1 | Syn. Ex. 1 | Syn. Ex. 1 |

TABLE 4-continued

| Production conditions and item determined | Ex. 7 | Ex. 8 | Ex. 9 | Ex. 10 |
|---|---|---|---|---|
| Amount of additive (% by weight) | 5 | 10 | 5 | 10 |
| Heat treatment temperature (° C.) | 120 | 100 | 120 | 100 |
| Interplanar spacing of (020) plane (nm) | 0.618 | 0.618 | 0.618 | 0.618 |
| Crystalline size of (020) plane (nm) | 7.5 | 7.5 | 7.5 | 7.5 |
| BET specific surface area ($m^2/g$) | 120 | 120 | 120 | 120 |
| Average pore radius (nm) | 7.0 | 7.0 | 7.0 | 7.0 |
| Half breadth (nm) | 3.5 | 3.5 | 3.5 | 3.5 |
| Peak 1 of pore distribution (nm) | 7.0 | 7.0 | 7.0 | 7.0 |
| Peak 2 of pore distribution (nm) | — | — | — | — |
| Pore volume (ml/g) | 0.60 | 0.60 | 0.60 | 0.60 |
| ($ml/m^2$) | 9.4 | 9.4 | 9.4 | 9.4 |
| Pore volume ratio of peak 2 (%) | — | — | — | — |
| Relative pressure difference (ΔP) | 0.04 | 0.04 | 0.04 | 0.04 |
| Ink-absorbing time (msec) | | | | |
| (Ink 1) (1 dot) | 200 | 200 | 200 | 200 |
| (100%) | 200 | 200 | 200 | 200 |
| (200%) | 400 | 400 | 400 | 400 |
| Ink-absorbing time (msec) | | | | |
| (Ink 2) (1 dot) | 200 | 200 | 200 | 200 |
| (100%) | 200 | 200 | 200 | 200 |
| (200%) | 400 | 400 | 400 | 400 |
| Dye-adsorbing capacity | 1500 | 1600 | 1200 | 1500 |
| (Ink 1, $mg/m^2$) | | | | |
| Dye-adsorbing capacity ratio | 0.6 | 1.1 | 0.9 | 1.0 |
| Index of dye-adsorbing rate | 2.7 | 0.4 | 2.0 | 1.7 |
| Surfactant-adsorbing capacity ($mg/m^2$) | 750 | 800 | 745 | 760 |
| Dot diameter | | | | |
| (Ink 1, μm) | 90 | 92 | 89 | 91 |
| (Ink 2, μm) | 85 | 87 | 84 | 86 |
| Dot diameter ratio | 1.06 | 1.06 | 1.06 | 1.06 |
| Ink absorbency (Ink 1) | A | A | A | A |
| Ink absorbency (Ink 2) | A | A | A | A |
| Optical density (Ink 1) | | | | |
| | (Y) | 2.00 | 1.99 | 2.001.99 |
| | (M) | 1.92 | 2.00 | 1.931.97 |
| | (C) | 2.00 | 1.95 | 1.971.96 |
| | (Bk) | 2.02 | 2.01 | 1.991.99 |
| Optical density (Ink 2) | | | | |
| (Y) | 2.00 | 1.96 | 1.99 | 2.00 |
| (M) | 1.93 | 1.99 | 1.94 | 1.99 |
| (C) | 1.99 | 1.98 | 1.97 | 1.95 |
| (Bk) | 1.99 | 2.00 | 2.00 | 1.97 |
| Observation of optical density from both sides | | | | |
| (Ink 1) | A | A | A | A |
| (Ink 2) | A | A | A | A |
| Feathering | | | | |
| (Ink 1, receiving layer side) | A | A | A | A |
| (Ink 1, base material side) | A | A | A | A |
| (Ink 2, receiving layer side) | A | A | A | A |
| (Ink 2, base material side) | A | A | A | A |
| Beading | | | | |
| (Ink 1, receiving layer side) | A | A | A | A |
| (Ink 1, base material side) | A | A | A | A |

TABLE 4-continued

| Production conditions and item determined | Ex. 7 | Ex. 8 | Ex. 9 | Ex. 10 |
|---|---|---|---|---|
| (Ink 2, receiving layer side) | A | A | A | A |
| (Ink 2, base material side) | A | A | A | A |
| Cissing | | | | |
| (Ink 1, receiving layer side) | A | A | A | A |
| (Ink 1, base material side) | A | A | A | A |
| (Ink 2, receiving layer side) | A | A | A | A |
| (Ink 2, base material side) | A | A | A | A |
| Haze degree | 4.0 | 4.0 | 4.1 | 4.1 |
| Resistance to cracking | A | A | A | A |
| Resistance to curling | A | A | A | A |
| Tack-free property | A | A | A | A |

TABLE 5

| Production conditions and item determined | Ex. 11 | Ex. 12 | Ex. 13 | Ex. 14 |
|---|---|---|---|---|
| Alumina hydrate | Syn. Ex. 2 | Syn. Ex. 3 | Syn. Ex. 4 | Syn. Ex. 5 |
| Amount of additive (% by weight) | None | None | None | None |
| Heat treatment temperature (° C.) | 120 | 120 | 120 | 120 |
| Interplanar spacing of (020) plane (nm) | 0.619 | 0.618 | 0.619 | 0.619 |
| Crystalline size of (020) plane (nm) | 7.3 | 7.4 | 7.4 | 6.7 |
| BET specific surface area ($m^2/g$) | 120 | 130 | 110 | 140 |
| Average pore radius (nm) | 8.3 | 6.5 | 8.4 | 6.0 |
| Half breadth (nm) | 3.2 | 2.9 | 3.0 | 1.5 |
| Peak 1 of pore distribution (nm) | 10.0 | 6.5 | 10.0 | 6.0 |
| Peak 2 of pore distribution (nm) | 2.5 | — | 2.5 | — |
| Pore volume (ml/g) | 0.60 | 0.60 | 0.60 | 0.55 |
| ($ml/m^2$) | 9.5 | 9.6 | 9.9 | 9.0 |
| Pore volume ratio of peak 2 (%) | 5 | — | 3 | — |
| Relative pressure difference (ΔP) | 0.03 | 0.03 | 0.04 | 0.14 |
| Ink-absorbing time (msec) | | | | |
| (Ink 1) (1 dot) | 200 | 200 | 200 | 200 |
| (100%) | 200 | 200 | 200 | 200 |
| (200%) | 400 | 400 | 400 | 400 |
| Ink-absorbing time (msec) | | | | |
| (Ink 2) (1 dot) | 200 | 200 | 200 | 200 |
| (100%) | 200 | 200 | 200 | 200 |
| (200%) | 400 | 400 | 400 | 400 |
| Dye-adsorbing capacity | 1550 | 1600 | 1600 | 1500 |
| (Ink 1, $mg/m^2$) | | | | |
| Dye-adsorbing capacity ratio | 0.9 | 1.0 | 1.1 | 1.0 |
| Index of dye-adsorbing rate | 3.0 | 2.8 | 1.7 | 2.4 |
| Surfactant-adsorbing capacity ($mg/m^2$) | 200 | 250 | 220 | 230 |
| Dot diameter | | | | |
| (Ink 1, μm) | 89 | 91 | 94 | 96 |
| (Ink 2, μm) | 86 | 88 | 91 | 93 |
| Dot diameter ratio | 1.03 | 1.03 | 1.03 | 1.03 |
| Ink absorbency (Ink 1) | A | A | A | A |
| Ink absorbency (Ink 2) | B | B | B | B |
| Optical density (Ink 1) | | | | |
| (Y) | 2.01 | 2.15 | 2.19 | 2.00 |
| (M) | 1.90 | 2.12 | 2.16 | 1.90 |

TABLE 5-continued

| Production conditions and item determined | Ex. 11 | Ex. 12 | Ex. 13 | Ex. 14 |
|---|---|---|---|---|
| (C) | 1.95 | 2.17 | 2.11 | 1.90 |
| (Bk) | 2.02 | 2.25 | 2.22 | 2.00 |
| Optical density (Ink 2) | | | | |
| (Y) | 1.82 | 2.04 | 2.01 | 1.80 |
| (M) | 1.79 | 2.04 | 2.00 | 1.82 |
| (C) | 1.81 | 2.06 | 2.02 | 1.81 |
| (Bk) | 1.83 | 2.04 | 2.02 | 1.85 |
| Observation of optical density from both sides | | | | |
| (Ink 1) | A | A | A | A |
| (Ink 2) | B | B | B | B |
| Feathering | | | | |
| (Ink 1, receiving layer side) | A | A | A | A |
| (Ink 1, base material side) | A | A | A | A |
| (Ink 2, receiving layer side) | B | B | B | B |
| (Ink 2, base material side) | B | B | B | B |
| Beading | | | | |
| (Ink 1, receiving layer side) | A | A | A | A |
| (Ink 1, base material side) | A | A | A | A |
| (Ink 2, receiving layer side) | B | B | B | B |
| (Ink 2, base material side) | B | B | B | B |
| Cissing | | | | |
| (Ink 1, receiving layer side) | A | A | A | A |
| (Ink 1, base material side) | A | A | A | A |
| (Ink 2, receiving layer side) | B | B | B | B |
| (Ink 2, base material side) | B | B | B | B |
| Haze degree | 4.5 | 4.0 | 4.3 | 4.5 |
| Resistance to cracking | A | A | A | A |
| Resistance to curling | A | A | A | A |
| Tack-free property | A | A | A | A |

TABLE 6

| Production conditions and item determined | Ex. 15 | Ex. 16 | Ex. 17 | Ex. 18 |
|---|---|---|---|---|
| Alumina hydrate | Syn. Ex. 2 | Syn. Ex. 3 | Syn. Ex. 4 | Syn. Ex. 5 |
| Amount of additive (% by weight) | 10 | 10 | 10 | 10 |
| Heat treatment temperature (° C.) | 100 | 100 | 100 | 100 |
| Interplanar spacing of (020) plane (nm) | 0.619 | 0.618 | 0.619 | 0.619 |
| Crystalline size of (020) plane (nm) | 7.3 | 7.4 | 7.4 | 6.7 |
| BET specific surface area ($m^2/g$) | 120 | 130 | 110 | 140 |
| Average pore radius (nm) | 8.3 | 6.5 | 8.4 | 6.0 |
| Half breadth (nm) | 3.2 | 2.9 | 3.0 | 1.5 |
| Peak 1 of pore distribution (nm) | 10.0 | 6.5 | 10.0 | 6.0 |
| Peak 2 of pore distribution (nm) | 2.5 | — | 2.5 | — |
| Pore volume (ml/g) | 0.60 | 0.60 | 0.60 | 0.55 |
| ($ml/m^2$) | 9.5 | 9.6 | 9.9 | 9.0 |
| Pore volume ratio of peak 2 (%) | 5 | — | 3 | — |
| Relative pressure difference (ΔP) | 0.03 | 0.03 | 0.04 | 0.14 |
| Ink-absorbing time (msec) | | | | |
| (Ink 1) (1 dot) | 200 | 200 | 200 | 200 |
| (100%) | 200 | 200 | 200 | 200 |
| (200%) | 400 | 400 | 400 | 400 |

TABLE 6-continued

| Production conditions and item determined | Ex. 15 | Ex. 16 | Ex. 17 | Ex. 18 |
|---|---|---|---|---|
| Ink-absorbing time (msec) | | | | |
| (Ink 2) (1 dot) | 200 | 200 | 200 | 200 |
| (100%) | 200 | 200 | 200 | 200 |
| (200%) | 400 | 400 | 400 | 400 |
| Dye-adsorbing capacity | 1300 | 1700 | 1700 | 1400 |
| (Ink 1, mg/m$^2$) | | | | |
| Dye-adsorbing capacity ratio | 0.8 | 1.0 | 0.9 | 1.1 |
| Index of dye-adsorbing rate | 1.9 | 2.3 | 1.7 | 2.2 |
| Surfactant-adsorbing capacity (mg/m$^2$) | 690 | 750 | 710 | 730 |
| Dot diameter | | | | |
| (Ink 1, μm) | 89 | 86 | 88 | 87 |
| (Ink 2, μm) | 84 | 81 | 83 | 82 |
| Dot diameter ratio | 1.06 | 1.06 | 1.06 | 1.06 |
| Ink absorbency (Ink 1) | A | A | A | A |
| Ink absorbency (Ink 2) | A | A | A | A |
| Optical density (Ink 1) | | | | |
| (Y) | 1.95 | 2.14 | 2.15 | 1.93 |
| (M) | 1.83 | 2.13 | 2.15 | 1.84 |
| (C) | 1.94 | 2.16 | 2.11 | 1.92 |
| (Bk) | 2.02 | 2.23 | 2.20 | 2.00 |
| Optical density (Ink 2) | | | | |
| (Y) | 1.93 | 2.15 | 2.12 | 1.89 |
| (M) | 1.86 | 2.11 | 2.10 | 1.89 |
| (C) | 1.97 | 2.14 | 2.08 | 1.96 |
| (Bk) | 2.00 | 2.19 | 2.21 | 2.02 |
| Observation of optical density from both sides | | | | |
| (Ink 1) | A | A | A | A |
| (Ink 2) | A | A | A | A |
| Feathering | | | | |
| (Ink 1, receiving layer side) | A | A | A | A |
| (Ink 1, base material side) | A | A | A | A |
| (Ink 2, receiving layer side) | A | A | A | A |
| (Ink 2, base material side) | A | A | A | A |
| Beading | | | | |
| (Ink 1, receiving layer side) | A | A | A | A |
| (Ink 1, base material side) | A | A | A | A |
| (Ink 2, receiving layer side) | A | A | A | A |
| (Ink 2, base material side) | A | A | A | A |
| Cissing | | | | |
| (Ink 1, receiving layer side) | A | A | A | A |
| (Ink 1, base material side) | A | A | A | A |
| (Ink 2, receiving layer side) | A | A | A | A |
| (Ink 2, base material side) | A | A | A | A |
| Haze degree | 4.2 | 4.2 | 4.1 | 4.1 |
| Resistance to cracking | A | A | A | A |
| Resistance to curling | A | A | A | A |
| Tack-free property | A | A | A | A |

TABLE 7

| Production conditions and item determined | Ex. 19 | Ex. 20 | Ex. 21 | Ex. 22 |
|---|---|---|---|---|
| Alumina hydrate | Syn. Ex. 2 | Syn. Ex. 3 | Syn. Ex. 4 | Syn. Ex. 5 |
| Amount of additive (% by weight) | 10 | 10 | 10 | 10 |
| Heat treatment temperature (° C.) | 100 | 100 | 100 | 100 |
| Interplanar spacing | 0.619 | 0.618 | 0.619 | 0.619 |

TABLE 7-continued

| Production conditions and item determined | Ex. 19 | Ex. 20 | Ex. 21 | Ex. 22 |
|---|---|---|---|---|
| of (020) plane (nm) | | | | |
| Crystalline size of (020) plane (nm) | 7.3 | 7.4 | 7.4 | 6.7 |
| BET specific surface area ($m^2/g$) | 120 | 130 | 110 | 140 |
| Average pore radius (nm) | 8.3 | 6.5 | 8.4 | 6.0 |
| Half breadth (nm) | 3.2 | 2.9 | 3.0 | 1.5 |
| Peak 1 of pore distribution (nm) | 10.0 | 6.5 | 10.0 | 6.0 |
| Peak 2 of pore distribution (nm) | 2.5 | — | 2.5 | — |
| Pore volume (ml/g) | 0.60 | 0.60 | 0.60 | 0.55 |
| (ml/$m^2$) | 9.5 | 9.6 | 9.9 | 9.0 |
| Pore volume ratio of peak 2 (%) | 5 | — | 3 | — |
| Relative pressure difference (ΔP) | 0.03 | 0.03 | 0.04 | 0.14 |
| Ink-absorbing time (msec) | | | | |
| (Ink 1) (1 dot) | 200 | 200 | 200 | 200 |
| (100%) | 200 | 200 | 200 | 200 |
| (200%) | 400 | 400 | 400 | 400 |
| Ink-absorbing time (msec) | | | | |
| (Ink 2) (1 dot) | 200 | 200 | 200 | 200 |
| (100%) | 200 | 200 | 200 | 200 |
| (200%) | 400 | 400 | 400 | 400 |
| Dye-adsorbing capacity | 1330 | 1660 | 1690 | 1410 |
| (Ink 1, mg/$m^2$) | | | | |
| Dye-adsorbing capacity ratio | 0.9 | 1.1 | 1.0 | 0.8 |
| Index of dye-adsorbing rate | 2.1 | 2.2 | 1.4 | 2.5 |
| Surfactant-adsorbing capacity (mg/$m^2$) | 710 | 755 | 735 | 745 |
| Dot diameter | | | | |
| (Ink 1, μm) | 88 | 92 | 93 | 97 |
| (Ink 2, μm) | 83 | 88 | 91 | 93 |
| Dot diameter ratio | 1.06 | 1.05 | 1.04 | 1.04 |
| Ink absorbency (Ink 1) | A | A | A | A |
| Ink absorbency (Ink 2) | A | A | A | A |
| Optical density (Ink 1) | | | | |
| (Y) | 1.99 | 2.16 | 2.20 | 1.99 |
| (M) | 1.93 | 2.14 | 2.17 | 1.93 |
| (C) | 1.97 | 2.14 | 2.14 | 1.94 |
| (Bk) | 2.00 | 2.19 | 2.20 | 2.01 |
| Optical density (Ink 2) | | | | |
| (Y) | 2.02 | 2.12 | 2.21 | 1.98 |
| (M) | 1.93 | 2.14 | 2.14 | 1.95 |
| (C) | 1.91 | 2.15 | 2.14 | 1.97 |
| (Bk) | 1.99 | 2.20 | 2.21 | 1.99 |
| Observation of optical density from both sides | | | | |
| (Ink 1) | A | A | A | A |
| (Ink 2) | A | A | A | A |
| Feathering | | | | |
| (Ink 1, receiving layer side) | A | A | A | A |
| (Ink 1, base material side) | A | A | A | A |
| (Ink 2, receiving layer side) | A | A | A | A |
| (Ink 2, base material side) | A | A | A | A |
| Beading | | | | |
| (Ink 1, receiving layer side) | A | A | A | A |
| (Ink 1, base material side) | A | A | A | A |
| (Ink 2, receiving layer side) | A | A | A | A |
| (Ink 2, base material side) | A | A | A | A |

TABLE 7-continued

| Production conditions and item determined | Ex. 19 | Ex. 20 | Ex. 21 | Ex. 22 |
|---|---|---|---|---|
| Cissing | | | | |
| (Ink 1, receiving layer side) | A | A | A | A |
| (Ink 1, base material side) | A | A | A | A |
| (Ink 2, receiving layer side) | A | A | A | A |
| (Ink 2, base material side) | A | A | A | A |
| Haze degree | 4.1 | 4.0 | 4.0 | 4.1 |
| Resistance to cracking | A | A | A | A |
| Resistance to curling | A | A | A | A |
| Tack-free property | A | A | A | A |

The printing media according to the present invention, the production process thereof and the printing method making use of these recording media have the following advantageous effects.

1. The ink-absorbing rate, dye-adsorbing capacity and index of dye-adsorbing rate of the printing medium to an ink containing 0.1% by weight of a surfactant are adjusted within the specified ranges, whereby the occurrence of beading can be prevented even when conducting printing with inks containing a surfactant. Besides, when a transparent base material is used, there can be provided an image on which no beading in the interior of the ink-receiving layer is observed even when observing from the side of the base material. Further, little difference arises in optical density and coloring of the image between the observation from the side of the ink-receiving layer and the observation from the side of the base material or between the observation by reflection and the observation by transmission.

2. The surfactant adsorption of the printing medium is adjusted within the specified range in addition to the adjustment of the ink-absorbing time, dye-adsorbing capacity and index of dye-adsorbing rate, whereby the occurrence of beading can be prevented even when conducting printing with inks containing a surfactant in an amount as great as about 1 to 10% by weight, so that the choice of inks can be permitted in a wide range.

3. In the production process of the printing medium according to the present invention, a porous ink-receiving layer is formed on a base material and then subjected to a heat treatment or the like, thereby delicately changing the surface profile of the porous material in the ink-receiving layer, so that the properties of the ink-receiving layer, i.e., ink-absorbing rate, dye-adsorbing capacity and index of dye-adsorbing rate, are satisfied. Therefore, the ink-absorbing rate, dye-adsorbing capacity and index of dye-adsorbing rate are adjusted within the recited ranges without changing the hydrophilicity•hydrophobicity of the ink-receiving layer, whereby the occurrence of beading can be prevented even when conducting printing with inks containing a surfactant. Further, the use of the metal alkoxide or the material capable of crosslinking a hydroxyl group positively causes a slight change of the ink-receiving layer, not a change of the hydrophilicity•hydrophobicity, whereby the occurrence of beading can be prevented even when conducting printing with inks containing a high proportion of surfactant.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A printing medium provided on a base material with a porous ink-receiving layer, wherein said printing medium is heat-treated after formation of the ink-receiving layer so that the dye-absorbing capacity ratio (B/A) of the ink-receiving layer is at least 0.6 when measured with ink (A) containing 0.1% by weight of a surfactant and ink (B) containing 1.0% by weight of the surfactant, said layer comprising an alumina hydrate having a boehmite structure, a binder and either a metal alkoxide or one or more materials capable of crosslinking a hydroxy group selected from the group consisting of aldehyde materials, melamine materials, urea materials and amide materials and, when measured with the ink containing 0.1% by weight of the surfactant, the time required to absorb 30 ng of the ink is 400 milliseconds or shorter, the dye-absorbing capacity is within the range of from 900 to 2,000 mg/m$^2$, and the index of dye-absorbing rate is within the range of from 0.0 to 5.0.

2. The printing medium according to claim 1, wherein the surfactant-adsorbing capacity of the ink-receiving layer falls within a range of from 300 to 1,000 mg/m$^2$.

3. The printing medium according to claim 1, wherein the interplanar spacing of the (020) plane of the alumina hydrate falls within a range of from 0.617 nm to 0.620 nm.

4. The printing medium according to claim 1, wherein the crystalline size in a direction perpendicular to the (020) plane of the alumina hydrate falls within a range of from 6.0 nm to 10.0 nm.

5. The printing medium according to claim 1, wherein the alumina hydrate contains 0.01 to 1.00% by weight of titanium dioxide in the alumina hydrate particle.

6. The printing medium according to claim 1, wherein the mean particle diameter or the mean particle length of the alumina hydrate falls within a range of from 1 nm to 50 nm.

7. The printing medium according to claim 1, wherein the average aspect ratio of the alumina hydrate falls within a range of from 3 to 10.

8. The printing medium according to claim 1, wherein the ink-receiving layer has a pore structure wherein the average pore radius is within a range of from 2.0 to 20.0 nm, and the half breadth of pore radius distribution is within a range of from 2.0 to 15.0 nm.

9. The printing medium according to claim 1, wherein the ink-receiving layer has two peaks in pore radius distribution.

10. The printing medium according to claim 9, wherein the two peaks in pore radius distribution are located at smaller then 10.0 nm and within a range of from 10.0 to 20.0 nm.

11. The printing medium according to claim 1, wherein the binder is polyvinyl alcohol.

12. The printing medium according to claim 1, wherein the mixing ratio of the alumina hydrate to the binder falls within a range of 5:1 to 20:1 by weight.

13. The printing medium according to claim 1, wherein the alumina hydrate is represented by the formula $$Al_2O_{3-n}(OH)_{2n}\cdot mH_2O$$

wherein n is an integer of 0 to 3, m is a number of 0 to 10 and n and m are not both zero.

* * * * *

UNITED STATES PATENT AND TRADEMARK OFFICE

CERTIFICATE OF CORRECTION

PATENT NO. : 6,576,324 B2
DATED : June 10, 2003
INVENTOR(S) : Hitoshi Yoshino et al.

It is certified that error appears in the above-identified patent and that said Letters Patent is hereby corrected as shown below:

Title page,
Item [30], Foreign Application Priority Data, "7-177495" should read -- 7-177459 --.

Column 10,
Line 12, "spacing-of" should read -- spacing of --.

Column 21,
Line 42, "an" should read -- the --.

Column 24,
Line 61, "the" should be deleted.

Column 25,
Line 63, "Crystalline]" should read -- Crystalline --.
Line 64, "Plane" should read -- Plane] --.

Column 26,
Line 42, "12. Quantitative" should read -- [12. Quantitative -- and "Dioxide" should read -- Dioxide] --.
Line 53, "13. Measurement" should read -- [13. Measurement -- and "Transmittance" should read -- Transmittance] --.

Column 28,
Line 33, "0.1101" should read -- 0.110 --.

Column 35,
Table 4, (Cont'd), Line 45 et seq., "Optical density (Ink 1)" should read --Optical density (Ink 1)

| | | | | |
|---|---|---|---|---|
| (Y) | 2.00 | 1.99 | 2.00 | 1.99 |
| (M) | 1.92 | 2.00 | 1.93 | 1.97 |
| (C) | 2.00 | 1.95 | 1.97 | 1.96 |
| (Bk) | 2.02 | 2.01 | 1.99 | 1.99 -- |

UNITED STATES PATENT AND TRADEMARK OFFICE

CERTIFICATE OF CORRECTION

PATENT NO. : 6,576,324 B2
DATED : June 10, 2003
INVENTOR(S) : Hitoshi Yoshino et al.

It is certified that error appears in the above-identified patent and that said Letters Patent is hereby corrected as shown below:

Column 46,
Line 66, “then” should read -- than --.

Signed and Sealed this

Second Day of March, 2004

JON W. DUDAS
*Acting Director of the United States Patent and Trademark Office*